US009636275B2

(12) United States Patent
Paine et al.

(10) Patent No.: US 9,636,275 B2
(45) Date of Patent: May 2, 2017

(54) INTEGRATED STORAGE AND DELIVERY SYSTEMS FOR NUTRITIONAL COMPOSITIONS

(76) Inventors: Greg Langdon Paine, Edina, MN (US); Sandra Lee Gray, Deptford, NJ (US)

( * ) Notice: Subject to any disclaimer, the term of this patent is extended or adjusted under 35 U.S.C. 154(b) by 1971 days.

(21) Appl. No.: 12/446,683

(22) PCT Filed: Nov. 15, 2007

(86) PCT No.: PCT/US2007/084734
§ 371 (c)(1),
(2), (4) Date: Mar. 1, 2010

(87) PCT Pub. No.: WO2008/064046
PCT Pub. Date: May 29, 2008

(65) Prior Publication Data
US 2010/0152700 A1 Jun. 17, 2010

Related U.S. Application Data

(60) Provisional application No. 60/866,297, filed on Nov. 17, 2006.

(51) Int. Cl.
*A61J 1/14* (2006.01)

(52) U.S. Cl.
CPC ..... *A61J 1/1406* (2013.01); *A61J 1/1412* (2013.01); *A61J 1/1418* (2015.05)

(58) Field of Classification Search
CPC ..... A61J 1/1406; A61J 1/1418; A61J 1/1412
(Continued)

(56) References Cited

U.S. PATENT DOCUMENTS

| | | | | |
|---|---|---|---|---|
| 3,967,621 A * | 7/1976 | Schwarz | A61M 5/288 604/192 |
| 4,604,093 A | 8/1986 | Brown et al. | |
| 4,895,275 A * | 1/1990 | Quinn et al. | 222/81 |
| 5,125,914 A * | 6/1992 | Bassin | 604/275 |
| 5,397,303 A | 3/1995 | Sancoff et al. | |
| 5,399,159 A * | 3/1995 | Chin et al. | 604/26 |

(Continued)

FOREIGN PATENT DOCUMENTS

| | | |
|---|---|---|
| DE | 36 18 158 A1 | 12/1987 |
| DE | 101 46 007 C1 | 10/2002 |

(Continued)

OTHER PUBLICATIONS

International Report on Patentability received in corresponding PCT Application No. PCT/US07/84734 filed Nov. 15, 2007.

(Continued)

*Primary Examiner* — Bhisma Mehta
*Assistant Examiner* — Benjamin Koo
(74) *Attorney, Agent, or Firm* — K&L Gates LLP

(57) ABSTRACT

Apparatuses, kits and methods useful in the storage and delivery of nutritional compositions and other fluids are described. In a general embodiment, an integrated storage and delivery system for nutritional compositions comprises a container defining a chamber, a finish, and a penetrable seal. The finish defines an opening and the penetrable seal separating the chamber from an external environment. A spike assembly is attached to the container. The spike assembly including a cap and a spike. The cap is engaged with the finish of the container and the spike defines a projection having a distal end defining a second opening. The projection is moveable between a first position in which the distal end is adjacent a first side of the penetrable seal and a second position in which the distal end is adjacent a second side of the penetrable seal.

28 Claims, 14 Drawing Sheets

(58) Field of Classification Search
USPC .... 604/232, 257, 403, 411, 275, 244, 93.01, 604/500, 506, 514; 422/512, 570
See application file for complete search history.

(56) References Cited

U.S. PATENT DOCUMENTS

| | | | | |
|---|---|---|---|---|
| 5,403,290 | A | 4/1995 | Noble | |
| 5,478,324 | A | 12/1995 | Meyer | |
| 6,391,014 | B1 | 5/2002 | Silverman | |
| 6,840,379 | B2 * | 1/2005 | Franks-Farah et al. | 206/571 |
| 2007/0093775 | A1 * | 4/2007 | Daly | 604/414 |

FOREIGN PATENT DOCUMENTS

| | | | |
|---|---|---|---|
| EP | 1 415 636 | A | 5/2004 |
| EP | 1415636 | A2 | 5/2004 |
| ES | 2169082 | | 5/1996 |
| JP | 2002-210023 | | 7/2002 |
| JP | 2002-522116 | | 7/2002 |
| WO | WO 93/13737 | A | 7/1993 |
| WO | WO 94/19034 | A | 9/1994 |
| WO | WO 95/05211 | A | 2/1995 |
| WO | WO 95/26772 | A | 10/1995 |
| WO | WO 02/09636 | A | 2/2002 |
| WO | WO 02/45473 | A | 6/2002 |
| WO | 2004045705 | | 6/2004 |

OTHER PUBLICATIONS

International Search Report received in corresponding PCT Application No. PCT/US07/84734 filed Nov. 15, 2007.

* cited by examiner

INTEGRATED STORAGE AND DELIVERY SYSTEMS FOR NUTRITIONAL COMPOSITIONS

CROSS REFERENCE TO RELATED APPLICATIONS

The present application is a National Stage of International Application No. PCT/US2007/084734, filed on Nov. 15, 2007, which claims priority to U.S. Provisional Pat. App. Ser. No. 60/866,297, filed Nov. 17, 2006, the entire contents of which arc being incorporated herein by reference.

FIELD

Apparatuses and methods useful in the storage and delivery of nutritional compositions and other fluids are described.

BACKGROUND

The delivery of nutritional compositions to animals, such as human patients, that cannot orally ingest food or other forms of nutrition is often of critical importance. For example, feeding tubes that deposit food directly into the gastrointestinal tract at a point below the mouth are often used to sustain life while a patient is unable, or refuses, to take food orally. Feeding tubes and other artificial delivery systems and routes can be used temporarily during the treatment of acute conditions. For chronic conditions, such systems and routes can be used as part of a treatment regimen that lasts for the remainder of a patient's life. No matter the duration of use, these devices often provide the only means for feeding the patient.

Fluid nutritional compositions, frequently referred to as 'formula,' are typically stored in a container that includes a seal that can be penetrated by a spike attached to a tube and patient access tip. Together, the spike, tube, and patient access tip are frequently referred to as a 'spike kit.' In conventional systems, formula containers and spike kits are provided as separate components, requiring a caregiver to 'spike' a container prior to delivering the formula to the patient. That is, a caregiver must separately obtain a container of formula and a spike kit, assemble the separate components into a complete system, activate the spike kit by passing a portion through the seal on the container, and finally prepare the patient and the spiked formula container for delivery to the patient.

The use of conventional formula containers and spike kits has several drawbacks, particularly in the clinical setting. For example, because the act of 'spiking' the container involves the collection and handling of multiple components, an opportunity to introduce contamination into the nutritional composition is created. Considering the direct route the composition will take into the patient, contaminated formula can lead to infection, including serious and difficult to treat nosocomial infections. Contaminated formula can also lead to microbial growth in the feeding tube, necessitating its flushing and/or replacement. Furthermore, the need for an assembly step for the separate components creates a Hazard Analysis Critical Control Point (HACCP), which must be monitored for quality control by the health care provider. To manage risk at the spiking HACCP, health care providers frequently conduct training on proper methods to spike formula containers. Over time, this training grows to be both costly and time-consuming as it is often repeated to address personnel changes and the need for reinforcement.

There is, therefore, a need in the art for an integrated storage and delivery system for nutritional compositions and other fluids.

SUMMARY OF EXEMPLARY EMBODIMENTS

The invention provides storage and delivery systems for use with nutritional compositions and other fluids.

An integrated storage and delivery system according to a first exemplary embodiment comprises a container defining a chamber, a finish, and a penetrable seal that separates the chamber from an external environment. The system also includes a spike assembly attached to the container. The spike assembly includes a cap and a spike. The cap is engaged with the finish of the container and the spike defines a projection that is moveable between first and second positions. In the first position, a distal end of the projection is disposed on a side of the penetrable seal that is opposite the side on which the chamber is disposed. In the second position, the distal end of the projection is disposed on the same side of the penetrable seal as the chamber. The spike assembly can further comprise a length of tubing defining a lumen and disposed between the spike and a patient access tip such that the passageway extends through the lumen.

In one exemplary embodiment, the finish of the container and the cap define complimentary threads that define a thread path. The distal end is moved between the first and second positions with advancement of a portion of the spike assembly along the thread path.

In another exemplary embodiment, the spike assembly includes a spring attached to the spike and biased toward a position that places the distal end of the projection in the second position. The distal end is moved between the first and second positions by removing a strain placed on the spring that maintains the distal end in the first position.

In an alternative exemplary embodiment, the integrated storage and delivery system for nutritional compositions comprises a container defining a chamber; a tubing having a first end attached to a chamber and a second end attached to a patient access tip adapted for insertion into a patient at a point of treatment; and at least one penetrable seal and/or seal device attached to the container, the tubing and/or the access tip. The penetrable seal and seal device are constructed and arranged to prevent passage of a fluid from the container to the access tip through the tubing.

The invention also provides methods of supplying nutritional compositions for non-oral delivery to a patient, such as a human patient. One exemplary method comprises the steps of filling a container with a nutritional composition; sealing the container with a penetrable seal; providing a spike set that includes a cap and a projection moveable between a first position in which the projection is disposed on an opposite side of the penetrable seal than said nutritional composition and a second position in which the projection is disposed on the same side of the penetrable seal as said nutritional composition; placing the projection in the first position; attaching the spike set to the container to form an integrated storage and delivery system; and supplying the integrated storage and delivery system to a user.

Kits and additional useful methods are also provided.

Additional understanding of the invention can be obtained with review of the detailed description of exemplary embodiments, below, and the appended drawings illustrating various exemplary embodiments.

BRIEF DESCRIPTION OF THE DRAWINGS

FIG. 14A illustrates the seal device in a first, or storage, position. FIG. 14B illustrates the seal device in a second, or delivery, position.

FIG. 15A illustrates the seal device in a first, or storage, position. FIG. 15B illustrates the seal device in a second, or delivery, position.

DETAILED DESCRIPTION OF EXEMPLARY EMBODIMENTS

The following detailed description and the appended drawings describe and illustrate exemplary embodiments of the invention solely for the purpose of enabling one of ordinary skill in the relevant art to make and use the invention. As such, the description and illustration of these embodiments are purely exemplary in nature and are in no way intended to limit the scope of the invention, or its protection, in any manner.

Figure 1:
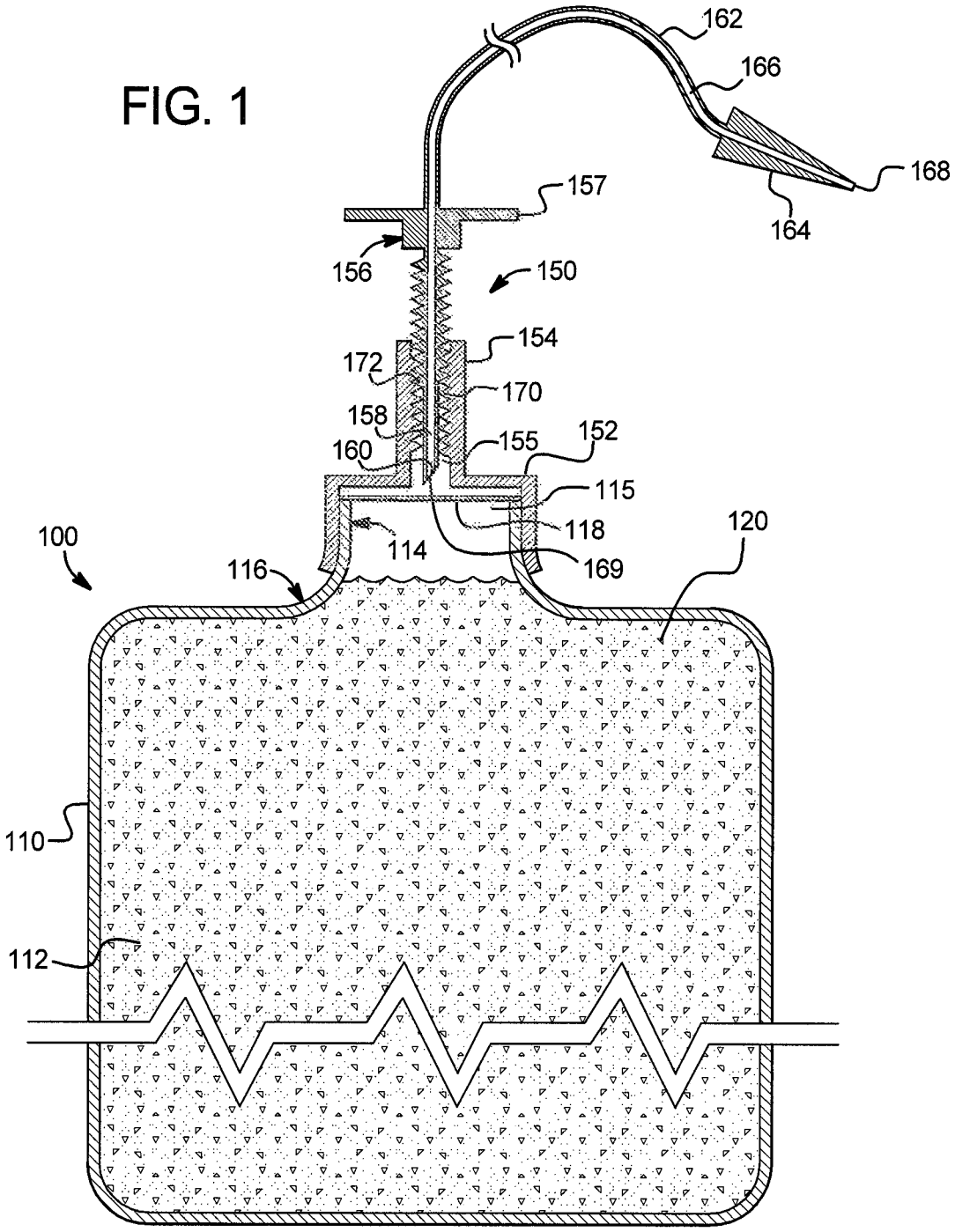
FIG. 1 is a sectional view of an integrated storage and delivery system according to a first exemplary embodiment. The spike of the storage and delivery system is shown in a first, or storage, position.
Figure 2:
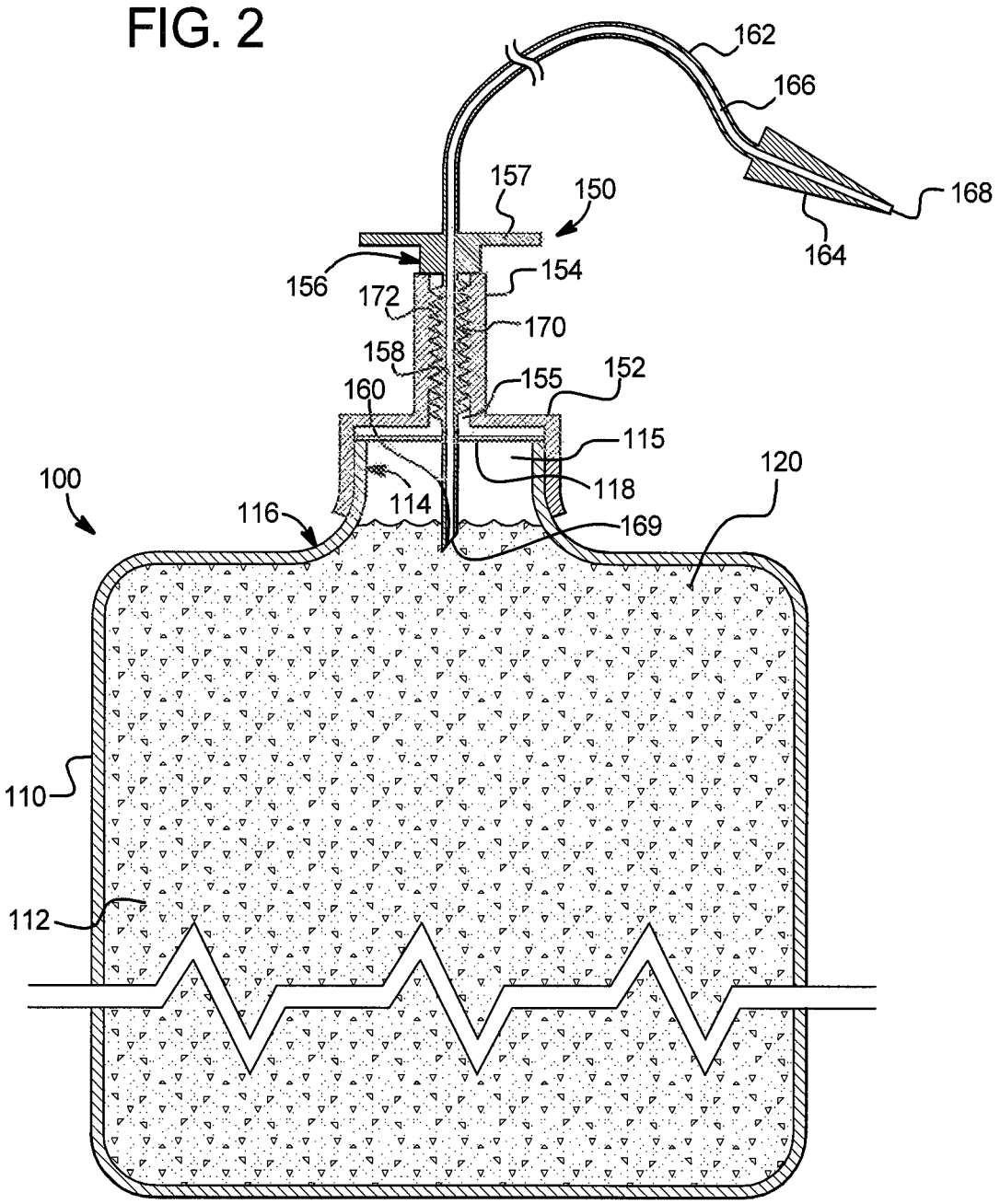
FIG. 2 is a sectional view of the integrated storage and delivery system illustrated in FIG. 1. The spike of the storage and delivery system is shown in a second, or delivery, position.

FIGS. 1 and 2 illustrate an integrated storage and delivery system 100 according to a first exemplary embodiment. The system 100 includes a storage container 110 that defines a chamber 112 and a finish 114. A neck region 116 forms a transition between the chamber 112 and the finish 114. The finish 114 defines an opening 115 that provides access to the chamber 112. A penetrable seal 118 is placed at or near the opening 115 to isolate the formula 120 or other liquid contained in the chamber 112 from the external environment.

A spike assembly 150 is attached to the storage container 110. The spike assembly 150 includes a cap 152 that engages the finish 114 of the container 110 and an upstanding portion 154 that defines a passageway 155. A spike 156 includes a grasping surface 157 and a projection 158. In this embodiment, the projection 158 comprises a needle having a distal end that defines a tapered edge 160 suitable for piercing the penetrable seal 118 of the storage container 110. It is expressly understood that the projection 158 can have any suitable form and configuration, including the illustrated and described needle form as well as other suitable alternatives, such as blunt ends, rounded ends, and the like.

The spike assembly 150 also includes length of tubing 162 and a patient access tip 164. A passageway 166 extends from an opening 168 defined by the patient access tip 164, through the tubing 162, grasping surface 157 and projection 158, and ultimately terminates at an opening 169 defined by the distal end of the projection 158. The passageway 166 provides a route of travel for the formula from the container 110 to the patient when the integrated storage and delivery system 100 is in use.

The cap 152 can engage the finish 114 of the container 110 in any suitable manner. An attachment that seals the external environment from the internal portion of the cap 152 and finish 114 is considered advantageous at least because it provides additional protection against contamination of the formula 120 that can result from contact with the external environment. Examples of suitable attachments between the cap 152 and finish 114 includes threaded connections, sealed threaded connections, clamp connections, bonded connections, including adhesive bonds, fused connections formed by fusing part of the cap 152 with part of the finish 114, such as by heating components made of plastic or other suitable materials to a suitable temperature for a suitable length of time to effect a fusing of the components. It is expressly contemplated, but not required, that the cap 152 and finish 114 can be integrally formed with each other.

The patient access tip 164 can comprise any suitable patient access termination, tip, or other suitable structure. A person skilled in the art can select an appropriate patient access tip 164 based on various considerations, including the intended point of access in the patient's body, the nature of the formula 120, and other appropriate considerations. Examples of suitable patient access tips 164 include needles, luer connectors adapted to connect to previously placed needles and other access devices, structures capable of being connected to a previously placed access port in the patient, such as a chest wall port that provides access to the stomach, jejunum and other suitable access ports, and other structures capable of delivering the formula 120 from the passageway in an appropriate manner. Also, the tubing 162 and patient access tip 164 can be configured as a nasogastric tube, orogastric tube, or in any other suitable configuration.

The spike assembly 150 is attached to the container 110 in a manner such that the projection 158 is moveable between first and second positions. As best illustrated in FIG. 1, when in the first position, the distal end of the projection 158 is disposed on an opposite side of the penetrable seal 118. In this position, the integrity of the penetrable seal 118 has not been compromised by the projection 158 and the formula 120 is isolated from the passageway 166 defined by the spike assembly. This position of the projection can be referred to as the 'storage position' as it is suitable for storing and transporting the system 100 prior to use of the formula 120.

FIG. 2 illustrates the projection 158 in the second position. In this position, the distal end of the projection 158 is disposed on the same side of the penetrable seal 118 as the formula 120. In this position, the formula 120 can be forced to enter the passageway 166 defined by the spike assembly 150, either by passive movement, application of a pumping force, or by other suitable means or actions. Accordingly, the second position can be referred to as the 'delivery position.'

The projection 158 is moveable between the storage and delivery positions. In this embodiment, an inner surface of the upstanding portion 154 the spike assembly 150 defines a first thread 170 and the outer surface of the projection 158 defines a second thread 172. A threaded connection is formed between the first 170 and second thread 172. It should be appreciated that the projection 158 can define the second thread 172 along any portion of the projection 158 (e.g. upper portion, middle portion and/or lower portion may contain threads).

The projection 158 is moved from the storage position to the delivery position by rotating the spike assembly 150, such as by grasping the grasping surface 157 and forcing the second thread 172 to advance along the first thread 170. Ultimately, as movement of the projection 158 continues, the distal end of the projection contacts and penetrates the penetrable seal 118, providing access to the formula 120.

In another embodiment, the spike assembly 150 can comprise a removable collar or tear strip to prevent the projection 158 from moving unnecessarily. For example, the removable collar or tear strip can be placed around the projection between the grasping surface 157 and the upstanding portion 154. When the integrated storage and delivery system 100 is ready to be used, the removable collar or tear strip can be removed to allow rotation of the projection 158 into the penetrable seal 118.

The integrated storage and delivery system 100 can be used in the following manner. First, a caregiver obtains the system 100 from a storage location. Initially, the projection 158 is in the storage position. Once the caregiver is ready to use the formula 120 within the container 110, s/he moves the projection 158 from the storage position to the delivery position. Movement of the formula 120 into and through the passageway 166 is initiated using a pump or other selected means for effecting movement or other suitable action. The patient access tip 164 is placed at a point of treatment near, on, or in the patient and delivery of the formula 120 to the patient is conducted. The order of these steps is not considered critical and is exemplary in nature. Indeed, any suitable order of steps, including any intervening, preliminary, or subsequent optional steps can be included in the use of the system 100.

Figure 3:
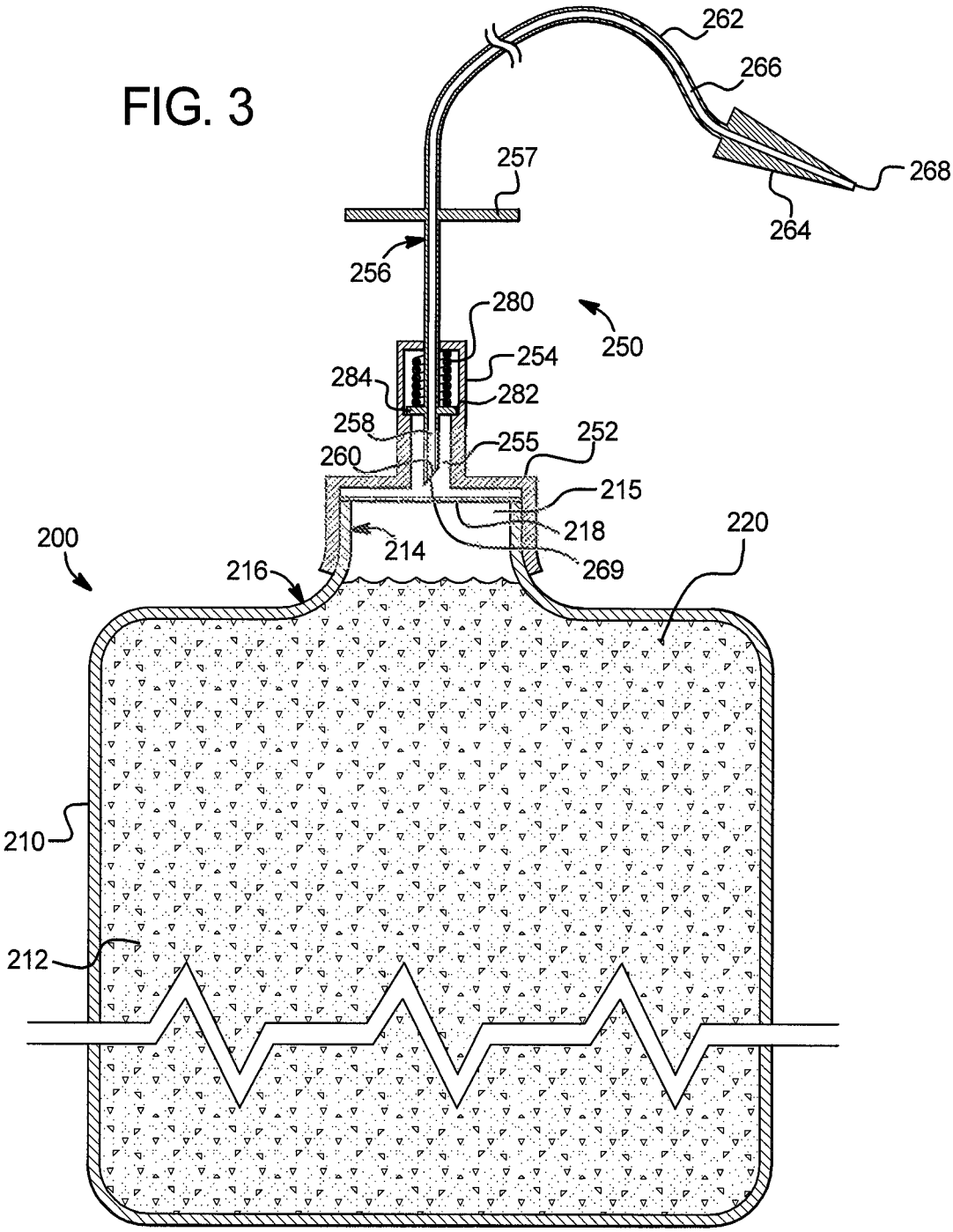
FIG. 3 is a sectional view of an integrated storage and delivery system according to a second exemplary embodiment. The spike of the storage and delivery system is shown in a first, or storage, position.
Figure 4:
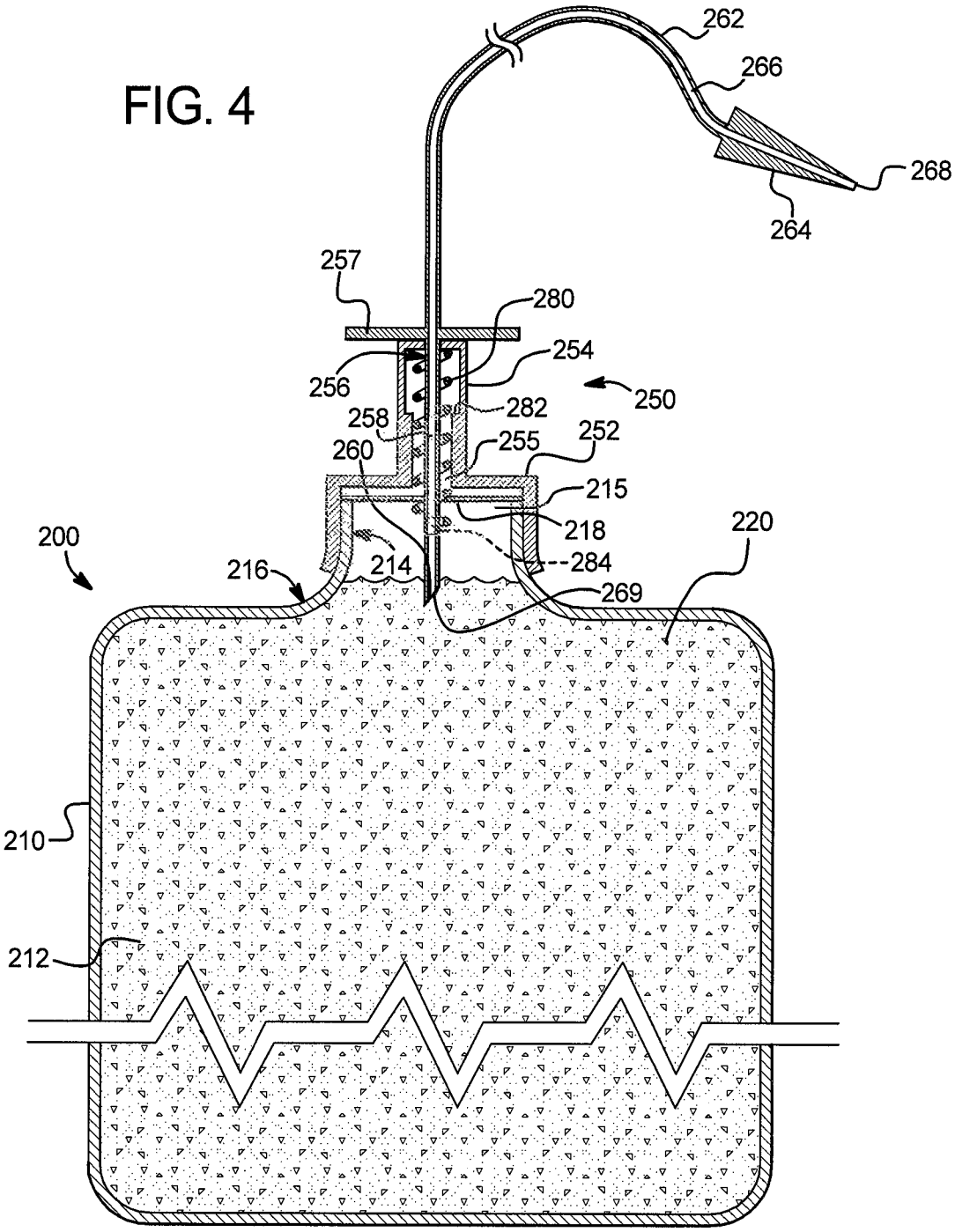
FIG. 4 is a sectional view of the integrated storage and delivery system illustrated in FIG. 3. The spike of the storage and delivery system is shown in a second, or delivery, position.

FIGS. 3 and 4 illustrate an integrated storage and delivery system 200 according to a second exemplary embodiment. The system 200 according to this embodiment is similar to the system 100 according to the first exemplary embodiment and illustrated in FIGS. 1 and 2, except as described below. The integrated storage and delivery system 200 includes a storage container 210 that defines a chamber 212 and a finish 214. A neck region 216 forms a transition between the chamber 212 and the finish 214. The finish 214 defines an opening 215 that provides access to the chamber 212. A penetrable seal 218 is placed at or near the opening 215 to isolate the formula 220 or other liquid contained in the chamber 212 from the external environment.

A spike assembly 250 is attached to the storage container 210. The spike assembly 250 includes a cap 252 that engages the finish 214 of the container 210 and an upstanding portion 254 that defines a passageway 255. A spike 256 includes a grasping surface 257 and a projection 258. A distal end of the projection 258 defines a tapered edge 260 suitable for piercing the penetrable seal 218 of the storage container 210. The spike assembly 250 also includes length of tubing 262 and a patient access tip 264. A passageway 266 extends from an opening 268 defined by the patient access tip 264, through the tubing 262, grasping surface 257 and projection 258, and ultimately terminates at an opening 269 defined by the distal end of the projection 258. The passageway 266 provides a route of travel for the formula from the container 210 to the patient when the integrated storage and delivery system 200 is in use.

The projection 258 is moveable between first, or storage, and second, or delivery, positions. In this embodiment, the movement of the projection 258 is accomplished by spring action. A spring 280 is attached to the projection and disposed within the passageway 255 defined by the upstanding portion 254. The inner surface of the upstanding portion 254 defines one or more shoulders 282 that engage one or more stops 284 disposed on the outer surface of the projection. When the stops 284 are engaged by the shoulders 282, the spring 280 is maintained in a compact position such that the distal end of the projection 258 is positioned on the opposite side of the penetrable seal 218 than the formula 220, thereby maintaining the projection 258 in the storage position. When the stops 284 are no longer engaged by the shoulders 282, the spring 280 is free to expand within the passageway 255 defined by the upstanding portion 254. During expansion, the spring 280 forces the projection 258 toward the container 210 such that the distal end of the projection 258 passes through the penetrable seal 218 and is ultimately disposed on the same side of the penetrable seal 218 as the formula 220. Following expansion of the spring in this manner, the projection 258 is in the delivery position and movement of the formula 220 through the passageway 266 can be initiated.

In another embodiment, the spike assembly 250 can comprise a removable collar or tear strip to prevent the projection 258 from moving unnecessarily. For example, the removable collar or tear strip can be placed around the projection between the grasping surface 257 and the upstanding portion 254. When the integrated storage and delivery system 200 is ready to be used, the removable collar or tear strip can be removed to allow rotation of the projection 258 into the penetrable seal 218.

A caregiver or other user can initiate movement of the projection 258 from the storage position to the delivery position by disengaging the stops 284 from the shoulders 282. In the illustrated embodiment, this can be accomplished by rotating the projection 258, such as by grasping the grasping surface 257, until the stops 284 are free of the shoulders 282 and the spring 280 is able to expand. As described above, the expansion of the spring 280 in response to this action by the user forcing the projection 258 into the delivery position. Once that is achieved, movement of the formula 220 into and through the passageway 266, an ultimately to the point of treatment in the patient, can be initiated.

Figure 5:
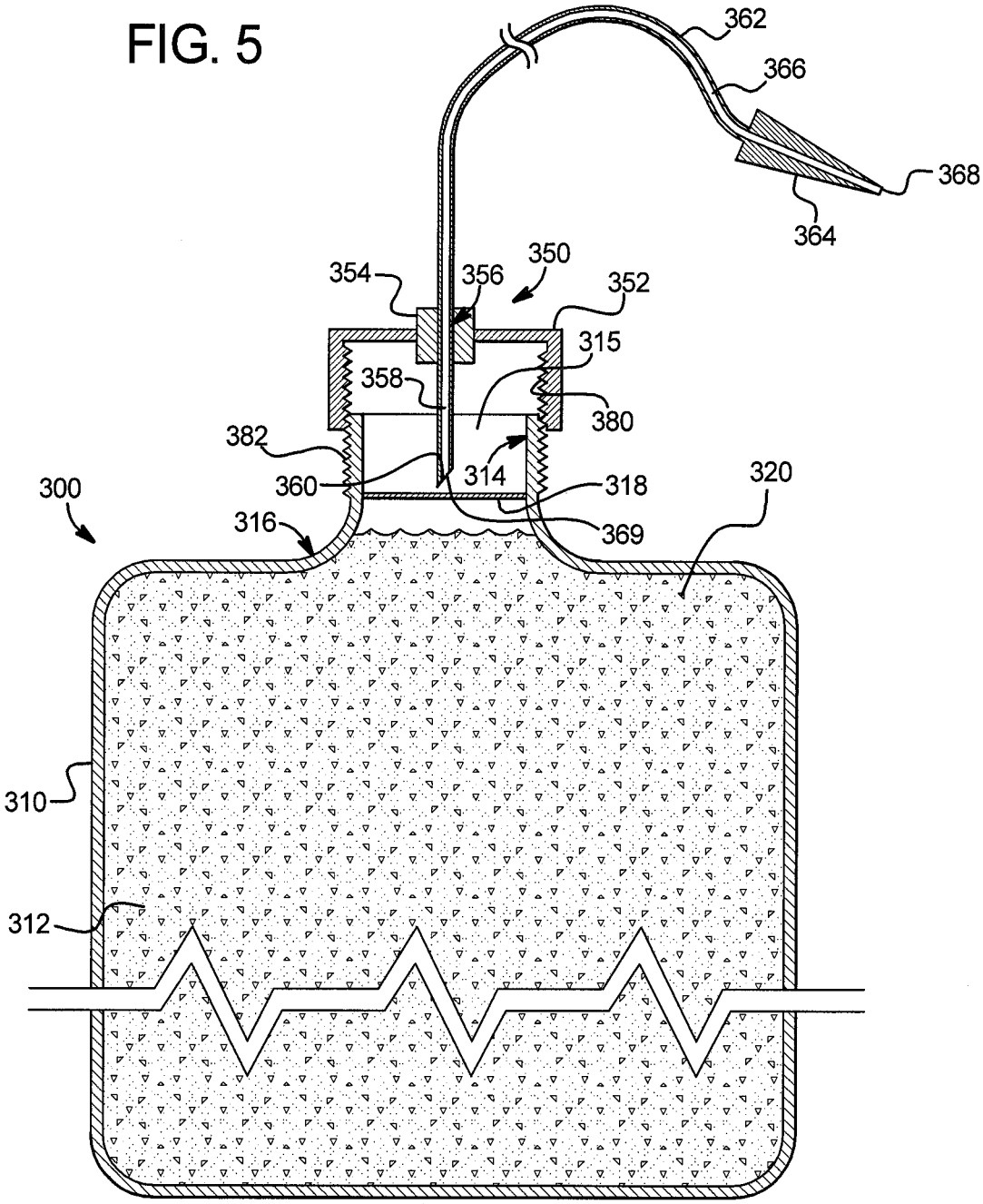
FIG. 5 is a sectional view of an integrated storage and delivery system according to a third exemplary embodiment. The spike of the storage and delivery system is shown in a first, or storage, position.
Figure 6:
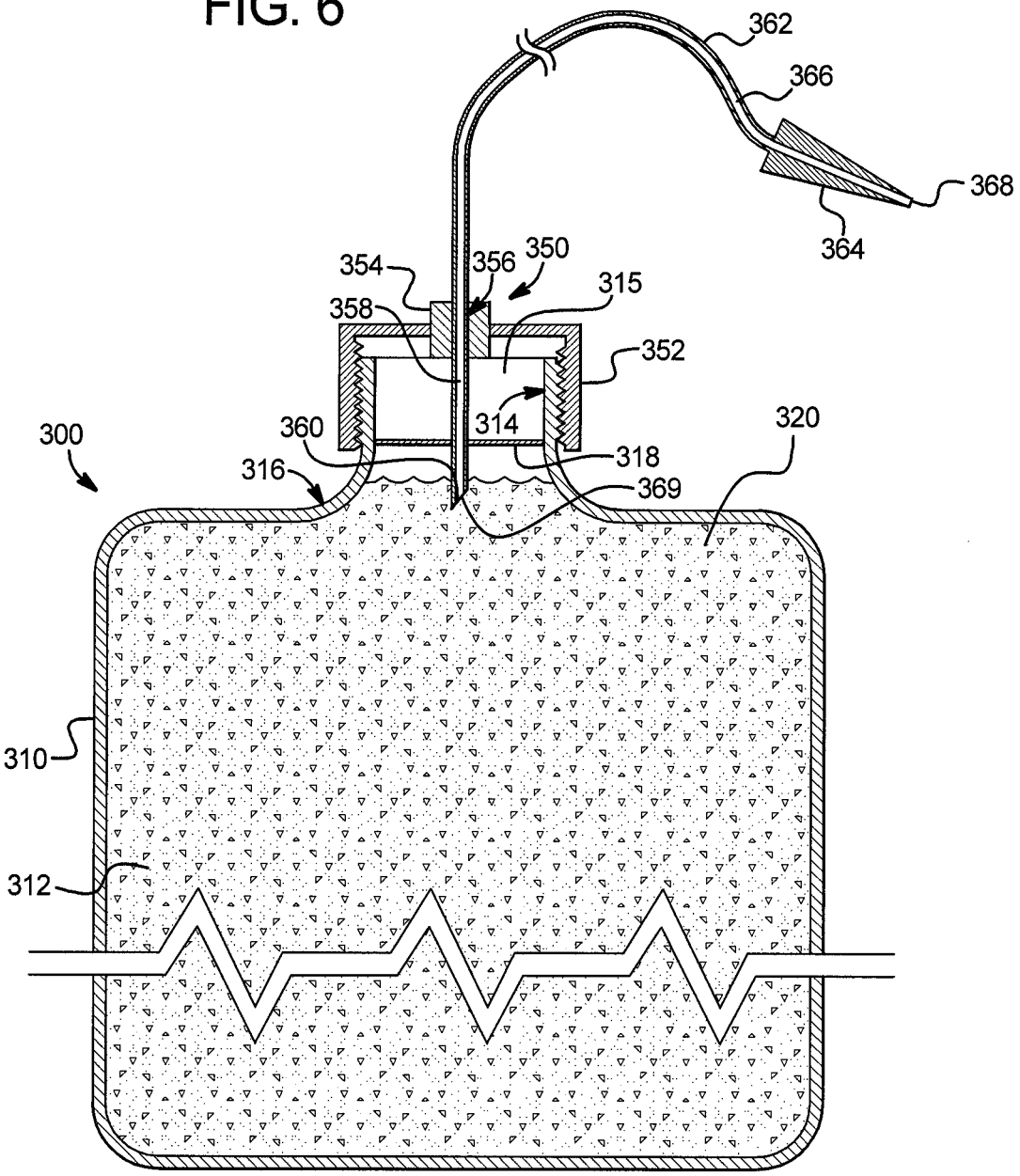
FIG. 6 is a sectional view of the integrated storage and delivery system illustrated in FIG. 5. The spike of the storage and delivery system is shown in a second, or delivery, position.

FIGS. 5 and 6 illustrate an integrated storage and delivery system 300 according to a third exemplary embodiment. The system 300 according to this embodiment is similar to the system 100 according to the first exemplary embodiment and illustrated in FIGS. 1 and 2, except as described below. The integrated storage and delivery system 300 includes a storage container 310 that defines a chamber 312 and a finish 314. A neck region 316 forms a transition between the chamber 312 and the finish 314. The finish 314 defines an opening 315 that provides access to the chamber 312. A penetrable seal 318 is placed at or near the opening 315 to isolate the formula 320 or other liquid contained in the chamber 312 from the external environment.

A spike assembly 350 is attached to the storage container 310. The spike assembly 350 includes a cap 352 that engages the finish 314 of the container 310 and a reinforcement section 354 adjacent a spike 356 that terminates in a projection 358. A distal end of the projection 358 defines a tapered edge 360 suitable for piercing the penetrable seal 318 of the storage container 310. The spike assembly 350 also includes a length of tubing 362 and a patient access tip 364. A passageway 366 extends from an opening 368 defined by the patient access tip 364, through the tubing 362 and projection 358, and ultimately terminates at an opening 369 defined by the distal end of the projection 358. The passageway 366 provides a route of travel for the formula 320 from the container 310 to the patient when the integrated storage and delivery system 300 is in use.

As in other embodiments described above, the projection 358 is moveable between first, or storage, and second, or delivery, positions. In this embodiment, the movement of the projection 358 is accomplished by rotating the cap 352 along a path defined by a first thread 380 on the inner surface of the cap 352 and a second thread 382 on the outer surface of the finish 314 of the container 310. Before such movement is initiated, the projection 358 is in the storage position, i.e., on an opposite side of the penetrable seal 318 than the formula 320. As the cap 352 is rotated along this path, it moves toward the neck region 316, carrying the projection 358 toward the penetrable seal 318. As best illustrated in FIG. 6, the projection 358 ultimately passes through the penetrable seal 318, placing the distal end 360 of the projection 358 on the same side of the penetrable seal 318 as the formula. At this point, the projection 358 is in the delivery position and movement of the formula 320 through the passageway 366 defined by the spike set 350 can be initiated.

While the cap 352 is illustrated with mating threads 380, 382 that permit the required movement of the projection 358 from the storage position to the delivery position, it is understood that other suitable structures that enable such movement of the cap 352, and the associated projection 358, can also be employed and are within the scope of the invention. For example, the cap 358 and finish 314 of the container 310 could define a series of mated baffles that allow the cap 358 to be pushed downward (i.e., toward the neck region 316) when a user desires to place the projection 358 in the delivery position.

Indeed, any suitable means for moving the projection between first and second positions can be used. The structures described herein are merely examples of suitable structure that can be used.

Figure 7:
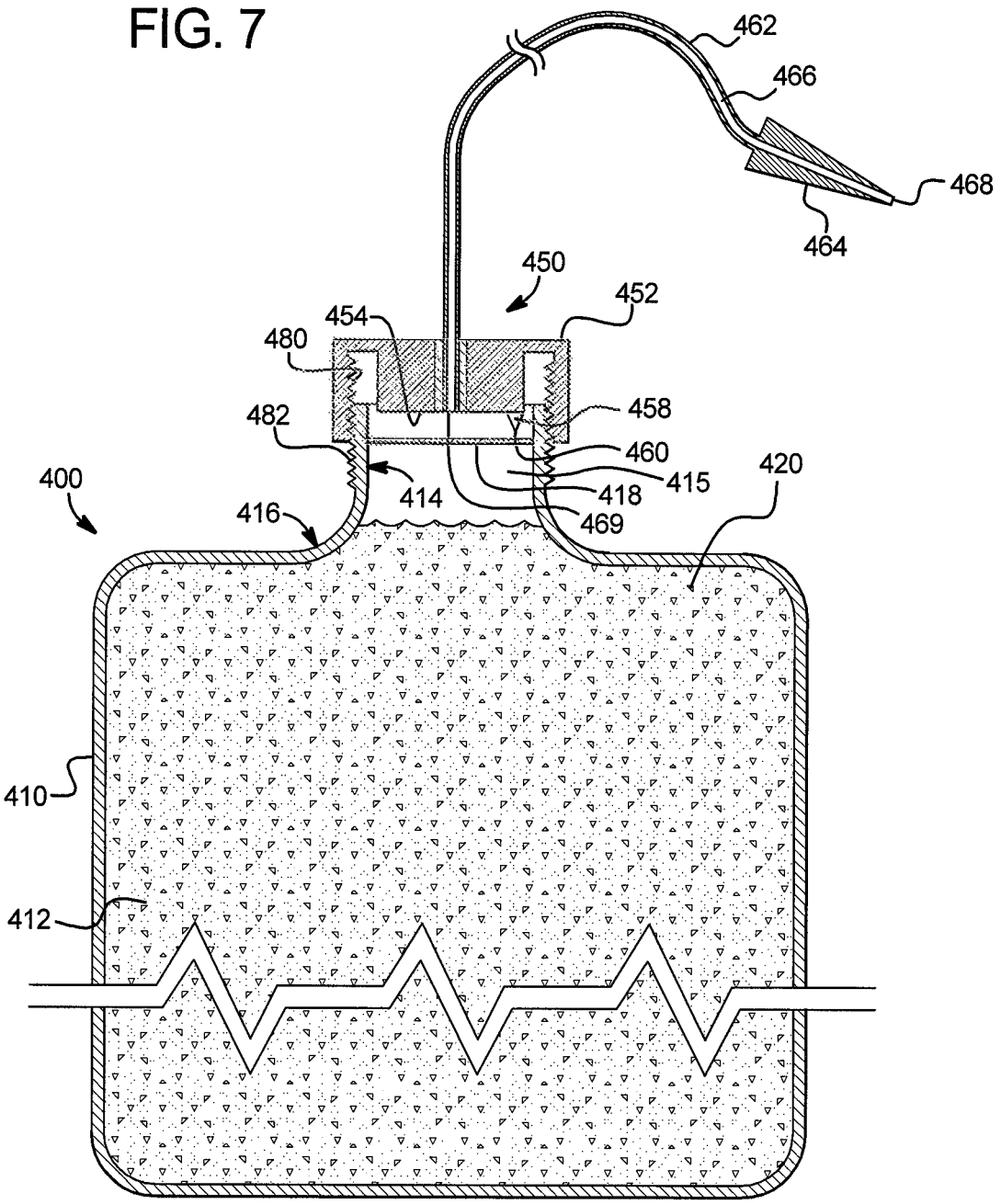
FIG. 7 is a sectional view of an integrated storage and delivery system according to a fourth exemplary embodiment. The spike of the storage and delivery system is shown in a first, or storage, position.
Figure 8:
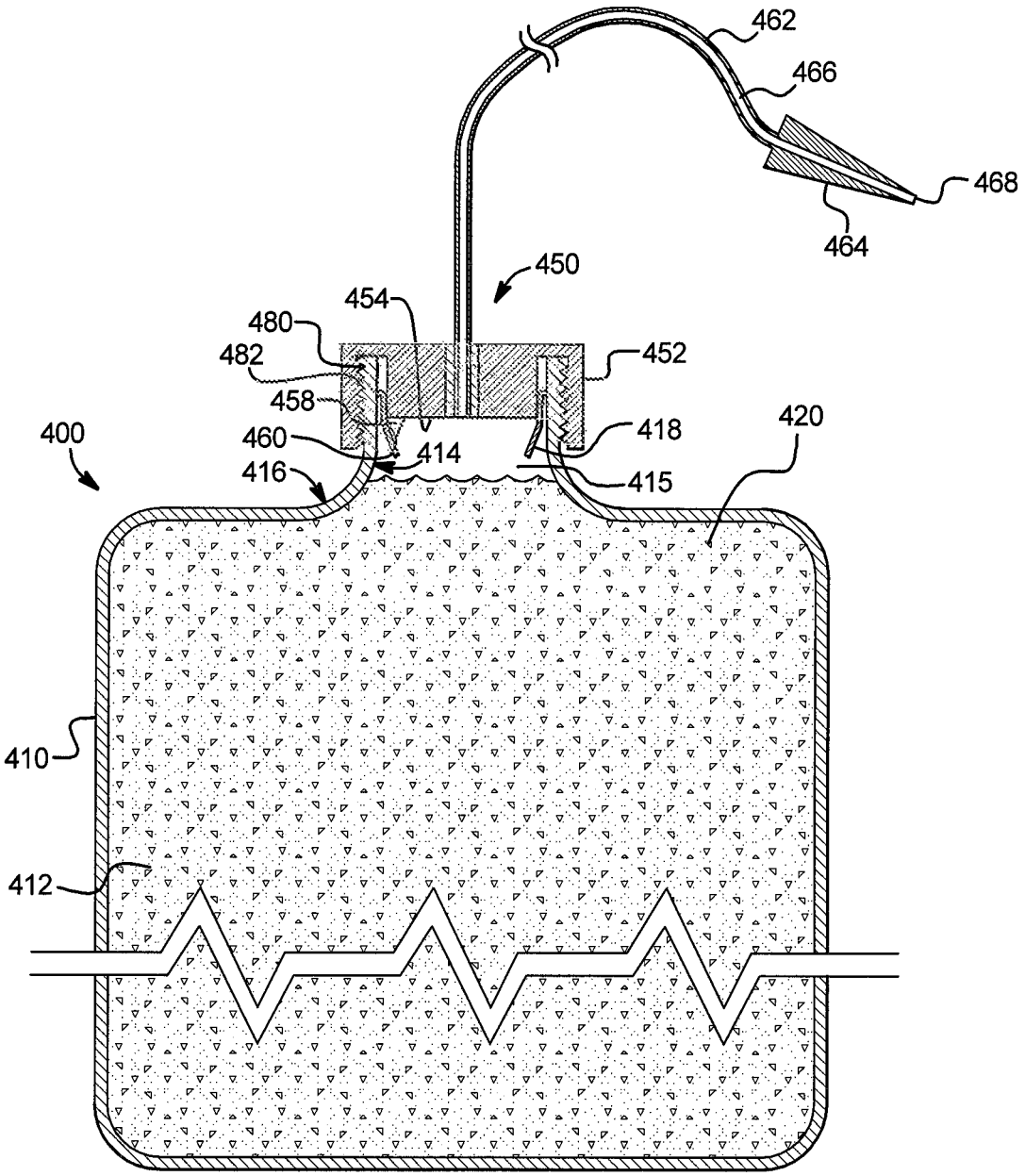
FIG. 8 is a sectional view of the integrated storage and delivery system illustrated in FIG. 7. The spike of the storage and delivery system is shown in a second, or delivery, position.

FIGS. 7 and 8 illustrate an integrated storage and delivery system 400 according to a fourth exemplary embodiment. The system 400 according to this embodiment is similar to the system 100 according to the first exemplary embodiment and illustrated in FIGS. 1 and 3, except as described below. The integrated storage and delivery system 400 includes a storage container 410 that defines a chamber 412 and a finish 414. A neck region 416 forms a transition between the chamber 412 and the finish 414. The finish 414 defines an opening 415 that provides access to the chamber 412. A penetrable seal 418 is placed at or near the opening 415 to isolate the formula 420 or other liquid contained in the chamber 412 from the external environment.

A spike assembly 450 is attached to the storage container 410. The spike assembly 450 includes a cap 452 that engages the finish 414 of the container 410. An underside 454 of the cap 452 defines a spike 458. In this embodiment, the spike 458 comprises a simple projection disposed on the underside 454 of the cap 452. As illustrated in the Figures, the spike 458 advantageously provides a point, edge, angle or other suitable structural feature that facilitates the piercing or other disruption of the penetrable seal 418 of the storage container 410. These features are considered optional, however, and the spike 458 need only be able to disrupt the penetrable seal 418 sufficiently enough to enable flow of the formula 420 or other liquid stored in the chamber 412, as will be described more fully below.

The spike 458 can be disposed at any suitable location on the underside of the cap 452. As illustrated in FIGS. 7 and 8, the spike 458 is advantageously positioned at a distance from the center of the cap 452. A positioning near or adjacent the perimeter of the underside 454 is considered particularly advantageous as this enables the spike 458 to form a continuous disruption of the penetrable seal 418 around the perimeter of the seal 418 as the cap 452 is advanced toward the container 410, also as described more fully below.

The spike assembly 450 also includes a length of tubing 462 and a patient access tip 464. A passageway 466 extends from an opening 468 defined by the patient access tip 464, through the tubing 462 and cap 452, and ultimately terminates at an opening 469 defined by the underside 454 of the cap 452. The passageway 466 provides a route of travel for the formula 420 from the container 410 to the patient when the integrated storage and delivery system 400 is in use.

As in other embodiments described above, the projection 458 is moveable between first, or storage, and second, or delivery, positions. In this embodiment, the movement of the projection 458 is accomplished by rotating the cap 452 along a path defined by a first thread 480 on the inner surface of the cap 452 and a second thread 482 on the outer surface of the finish 414 of the container 410. Before such movement is initiated, the projection 458 is in the storage position, i.e., on an opposite side of the penetrable seal 418 than the formula 420. This position is illustrated in FIG. 7. As the cap 452 is rotated along this path, it moves toward the neck region 416, carrying the projection 458 toward the penetrable seal 418. As best illustrated in FIG. 8, the projection 458 ultimately pierces or otherwise disrupts the penetrable seal 418, placing the distal end 460 of the projection 458 on the same side of the penetrable seal 418 as the formula 420. At this point, the projection 458 is in the delivery position and movement of the formula 420 through the passageway 466 defined by the spike set 450 can be initiated.

The cap 452 is advantageously sized and configured such that its rotation causes the projection 458 to create a near complete disruption of the penetrable seal 418 around its perimeter. This results in the seal 418 retaining some connection to the container 410 following placement of the projection 458 into the delivery position. While embodiments that completely separate the seal 418 from the container 410 are contemplated and indeed are within the scope of the invention, these embodiments are considered less advantageous for certain applications of the invention at least because the complete separation of the seal 418 from the container 410 might result in its entry into the formula 420 or even into the passageway 466. This advantageous sizing and configuration of the cap 452 can be achieved by manipulating various structural features of the cap 452 and container 410, including the threads 480, 482.

While the cap 452 is illustrated with mating threads 480, 482 that permit the required movement of the projection 458 from the storage position to the delivery position, it is understood that other suitable structures that enable such movement of the cap 452, and the associated projection 458, can also be employed and are within the scope of the invention. For example, the cap 458 and finish 414 of the container 410 could define a series of mated baffles that allow the cap 458 to be pushed downward (i.e., toward the neck region 416) when a user desires to place the projection 458 in the delivery position.

Figure 9:
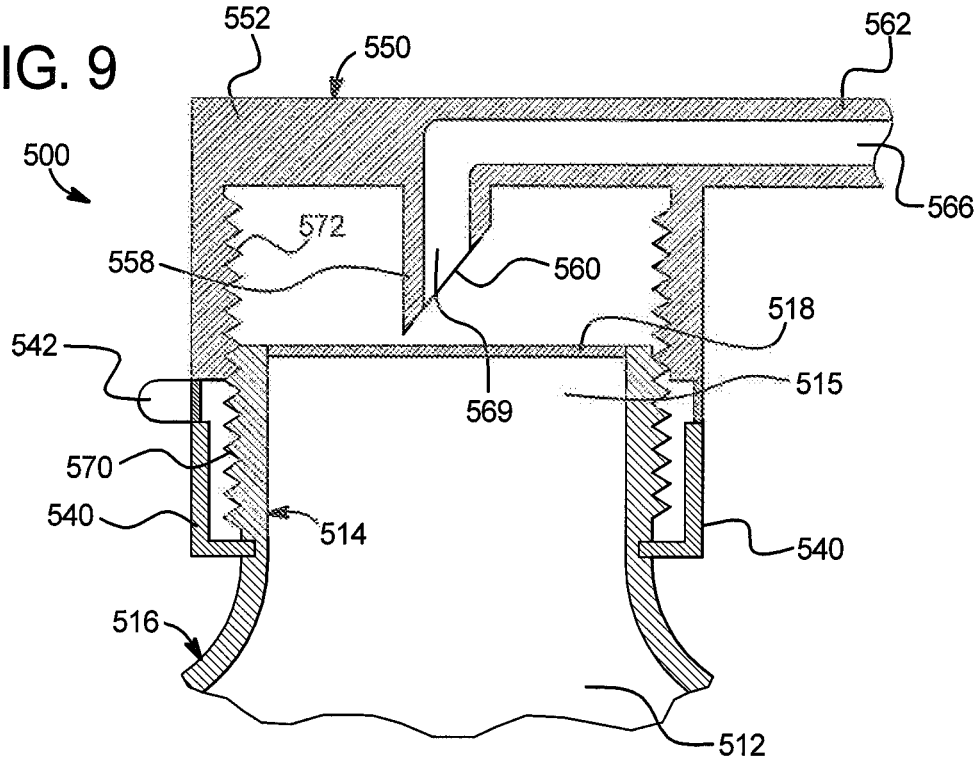
FIG. 9 is a sectional view of the integrated storage and delivery system according to a fifth exemplary embodiment.

FIG. 9 illustrates an integrated storage and delivery system 500 according to a fifth exemplary embodiment. The integrated storage and delivery system 500 includes a storage container (e.g. similar to the previously described embodiments) that defines a chamber 512 and a finish 514. A neck region 516 forms a transition between the chamber 512 and the finish 514. The finish 514 defines an opening 515 that provides access to the chamber 512. A penetrable seal 518 is placed at or near the opening 515 to isolate a formula or other liquid contained in the chamber 512 from the external environment.

A spike assembly 550 is attached to the finish 514 of the storage container. The spike assembly 550 includes a cap 552 that engages the finish 514 of the container. The cap 552 includes a spike or projection 558. The projection 558 can being integrally attached to the cap 552. The projection 558 and the cap 552 define a single passage 566 in fluid communication with a passage of a tubing 562.

In this embodiment, the projection 558 is in the form of a needle having a distal end that defines a tapered edge 560 suitable for piercing the penetrable seal 518. It is expressly understood that the spike or projection 558 can have any suitable form and configuration, including the illustrated and described needle form as well as other suitable alternatives, such as blunt ends, rounded ends, and the like.

The spike assembly 550 also includes a suitable length of tubing 562 and a patient access tip (not shown) similar to the access tips of the previously described embodiments. The passageway 566 extends from an opening defined by the patient access tip, through the tubing 562, cap 552 and projection 558, and ultimately terminates at an opening 569 defined by the distal end of the projection 558. The passageway 566 provides a route of travel for the formula or liquid from the container to the patient when the integrated storage and delivery system 500 is in use.

The cap 552 can engage the finish 514 of the container 110 in any suitable manner. An attachment that seals the external environment from the internal portion of the cap 552 and finish 514 is considered advantageous at least because it provides additional protection against contamination of the formula in the container that can result from contact with the external environment. Examples of suitable attachments between the cap 552 and finish 514 includes threaded connections (shown in FIG. 9), sealed threaded connections, clamp connections, bonded connections, including adhesive bonds, fused connections formed by fusing part of the cap 552 with part of the finish 514, such as by heating components made of plastic or other suitable materials to a suitable temperature for a suitable length of time to effect a fusing of the components. It is expressly contemplated, but not required, that the cap 552 and finish 514 can be integrally formed with each other.

The spike assembly 550 can further comprise a removable collar or tear strip 540 to prevent the projection 558 from moving unnecessarily. The tear strip 540 can comprise a tab 542 to allow a user to easily grasp and remove the tear strip 540. The tear strip 540 can be removably attached to the cap 552 and be removably attached around the finish 514. As a result, the tear strip 540 holds the cap 552 in place around the finish 514. When the integrated storage and delivery system 500 is ready to be used, the removable collar or tear strip 540 can be removed to allow rotation of the projection 558 into the penetrable seal 518.

Once the tear strip 540 is removed, the projection 558 is moveable between a storage position and a delivery position. For example, an outer surface of the finish 514 defines a first thread 570 and the inner surface of the cap 552 defines a second thread 572. A threaded connection is formed between the first 570 and second thread 572. The projection 558 is moved from the storage position to the delivery position by rotating the spike assembly 550, such as by grasping the cap 552 and forcing the second thread 572 to advance along the first thread 570. Ultimately, as movement of the projection 558 continues, the distal end of the projection 558 contacts and penetrates the penetrable seal 518, providing access to the formula or liquid in the container.

In an alternative embodiment, the cap 552 is made of a flexible material. This allows a user to break the penetrable seal 518 by pressing on the top of the cap 552 so that the projection 558 is lowered and pierces the penetrable seal 518. As a result, the user may not need to rotate the cap 552 to access the formula or liquid in the container.

Figure 10:
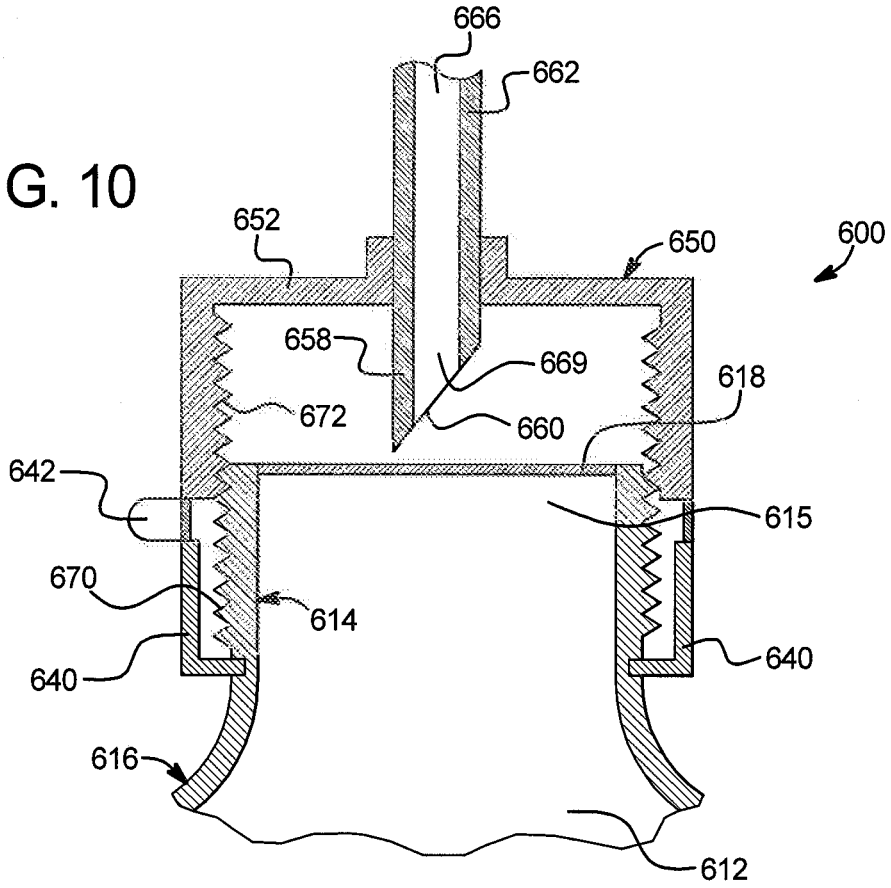
FIG. 10 is a sectional view of the integrated storage and delivery system according to a six exemplary embodiment.

FIG. 10 illustrate an integrated storage and delivery system 600 according to a sixth exemplary embodiment. The integrated storage and delivery system 600 includes a storage container (e.g. similar to the previously described embodiments) that defines a chamber 612 and a finish 614. A neck region 616 forms a transition between the chamber 612 and the finish 614. The finish 614 defines an opening 615 that provides access to the chamber 612. A penetrable seal 618 is placed over the opening 615 to isolate the formula 620 or other liquid contained in the chamber 612 from the external environment.

A spike assembly 650 is attached to the finish 614 of the storage container. The spike assembly 650 includes a cap 652 that engages the finish 614 of the container. The spike assembly 650 further includes a projection 658. In this embodiment, the projection 658 comprises a needle having a distal end that defines a tapered edge 660 suitable for piercing the penetrable seal 618 of the storage container. It is expressly understood that the projection 658 can have any suitable form and configuration, including the illustrated and described needle form as well as other suitable alternatives, such as blunt ends, rounded ends, and the like.

The spike assembly 650 also includes a suitable length of tubing 662 and a patient access tip (not shown) similar to the access tips of the previously described embodiments. A passageway 666 extends from an opening defined by the patient access tip, through the tubing 662, spike 656 and projection 658, and ultimately terminates at an opening 669 defined by the distal end of the projection 658. The passageway 666 provides a route of travel for the formula from the container to the patient when the integrated storage and delivery system 600 is in use.

The cap 652 can engage the finish 614 of the container in any suitable manner as described in previous embodiments. An attachment that seals the external environment from the internal portion of the cap 652 and finish 614 is considered advantageous at least because it provides additional protection against contamination of the formula or liquid in the container that can result from contact with the external environment. It is expressly contemplated, but not required, that the cap 652 and finish 614 can be integrally formed with each other.

The spike assembly 650 can further comprise a removable collar or tear strip 640 to prevent the projection 658 from moving unnecessarily. The tear strip 640 can comprise a tab 642 to allow a user to easily grasp and remove the tear strip 640. The tear strip 640 can be removably attached to the cap 652 and removably attached around the finish 614. As a result, the tear strip 640 holds the cap 652 in place around the finish 614. When the integrated storage and delivery system 600 is ready to be used, the removable collar or tear strip 640 can be removed to allow rotation of the projection 658 into the penetrable seal 618.

Once the tear strip 640 is removed, the projection 658 is moveable between a storage position and a delivery position. For example, an outer surface of the finish 614 defines a first thread 670 and the inner surface of the cap 652 defines a second thread 672. A threaded connection is formed between the first 670 and second thread 672. The projection 658 is moved from the storage position to the delivery position by rotating the spike assembly 650, such as by grasping the cap 652 and forcing the second thread 672 to advance along the first thread 670. Ultimately, as movement of the projection 658 continues, the distal end of the projection contacts and penetrates the penetrable seal 618, providing access to the formula or liquid in the container.

In alternative embodiments for the integrated storage and delivery systems shown in FIGS. 9 and 10, the outer surface of the finish can define one or more shoulders that engage one or more stops disposed on the inner surface of the cap. Alternatively, the inner surface of the finish can defines one or more shoulders that engage one or more stops disposed on the outer surface of the projection. Similar to previously described embodiments, when the stops are engaged by the shoulders, the cap is maintained in a storage position such that the distal end of the projection is positioned on the opposite side of the penetrable seal than the formula, thereby maintaining the projection in the storage position. When the cap is rotated so that the stops are no longer engaged by the shoulders, the cap can be lowered so that the projection moves toward the container and the distal end of the projection passes through the penetrable seal and is ultimately disposed on the same side of the penetrable seal as the formula or liquid in the container. Ultimately, as movement of the projection continues, the distal end of the projection provides access to the formula or liquid in the container.

Figure 11:
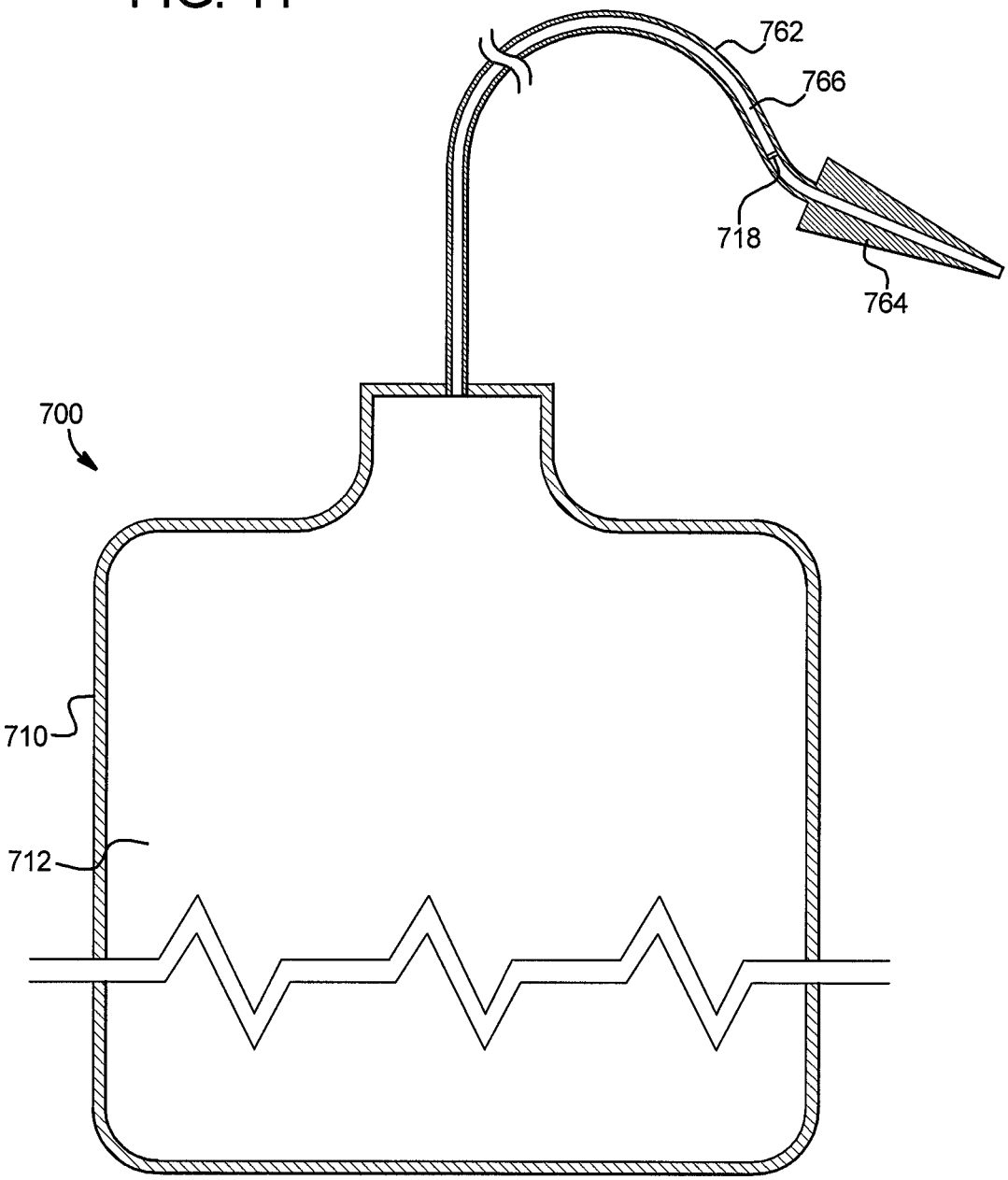
FIG. 11 is a sectional view of the integrated storage and delivery system according to a seventh exemplary embodiment.

FIGS. 11 through 15 illustrate additional exemplary embodiments of integrated storage and delivery systems of the present disclosure. FIG. 11 illustrates an integrated storage and delivery system 700 according to a seventh exemplary embodiment. The integrated storage and delivery system 700 includes a storage container 710 that defines a chamber 712. The storage container is attached to a tubing 762 that is attached to a patient access tip 764. A passageway 766 extends from an opening 768 defined by the patient access tip 764, through the tubing 762 and ultimately terminates at an opening 769 defined by a distal end of the tubing 762 attached to the container 710. The passageway 766 provides a route of travel for the formula from the container 710 to the patient when the integrated storage and delivery system 700 is in use.

The tubing 762 comprises a breakable seal 718 to isolate a formula or other liquid contained in the chamber 712 from the external environment. The breakable seal 718 can be placed at any location along the tubing 710, entrance of the storage container 710 or at the patient access tip 764. The tubing 762 can also comprise more than one penetrable seal at any location along the tubing 762. The breakable seal 718 can be broken using any suitable mechanism such as, for example, a spike or puncturing that can access the seal. The breakable seal 718 can also be broken using fluid pressure from the formulation or fluid inside the container 710.

Figure 12:
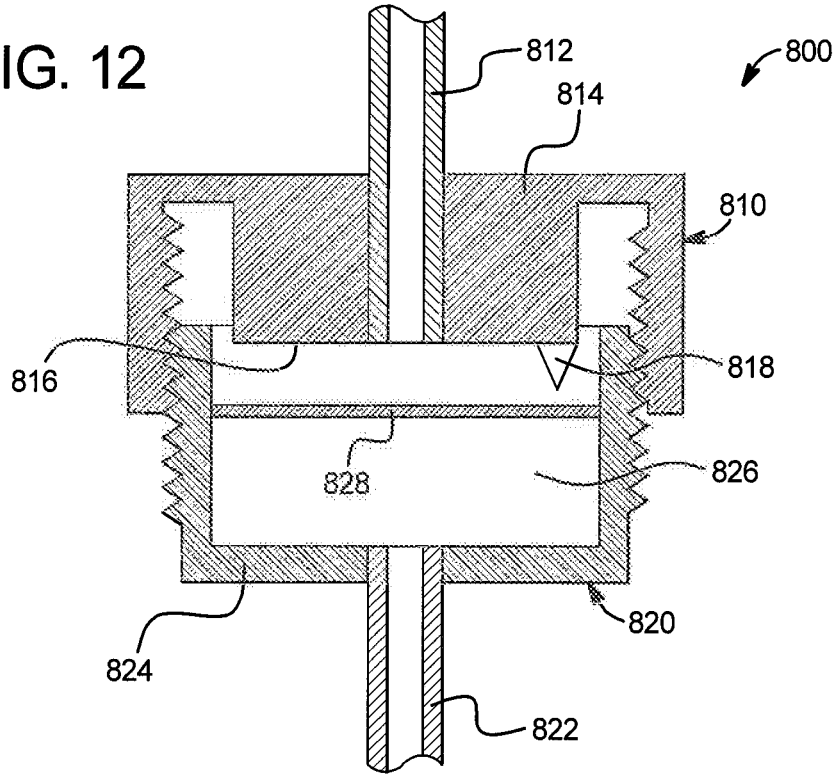
FIG. 12 is a sectional view of a seal device for the integrated storage and delivery system according to an exemplary embodiment.

In alternative embodiments of the integrated storage and delivery systems, the tubing 762 can comprise alternative seal devices in addition to or in place of the breakable seal 718. FIG. 12 illustrates a seal device 800 for the integrated storage and delivery system 700 according to an exemplary embodiment. The seal device 800 comprises a first assembly 810 attached to a second assembly 820. The first assembly 810 is attached to a first tubing 812, which can be attached to any suitable patient access tip. The second assembly 820 is attached to a second tubing 822, which can be attached to a storage container. The first assembly 810 includes a cap 814 having an underside 816 that defines a projection or spike 818. In this embodiment, the spike 818 comprises a simple projection disposed on the underside 816 of the cap 814. The second assembly 820 comprises a fitting 824 that defines an opening 826 that provides access to the second tubing 822. A penetrable seal 828 is placed over the opening 826 to seal the tubing 822 that is attached to the storage container.

The cap 814 of the first assembly 810 engages the fitting 824 of the second assembly 820. As illustrated in FIG. 12, the spike 818 advantageously provides a point, edge, angle or other suitable structural feature that facilitates the piercing or other disruption of the penetrable seal 828 of the second assembly 820. These features are considered optional, however, and the spike 818 need only be able to disrupt the penetrable seal 828 sufficiently enough to enable flow of a formula or other liquid stored in the chamber.

The spike 818 can be disposed at any suitable location on the underside of the cap 814. For example, the spike 818 is advantageously positioned at a distance from the center of the cap 814. A positioning near or adjacent the perimeter of the underside 816 is considered particularly advantageous as this enables the spike 818 to form a continuous disruption of the penetrable seal 828 around the perimeter of the seal 828 as the cap 814 is advanced toward the second assembly 820.

The movement of the spike 818 is accomplished by rotating the cap 814 along a path defined by a first thread 830 on the inner surface of the cap 814 and a second thread 832 on the outer surface of the fitting 824 of the second assembly 820. As the cap 814 is rotated along this path, it moves toward the fitting 824, carrying the spike 818 toward the penetrable seal 828. The spike 818 ultimately pierces or otherwise disrupts the penetrable seal 828. At this point, the movement of the formula or liquid through the seal device 800 can be initiated.

While the cap 814 is illustrated with mating threads that permit the required movement of the spike 818, it is understood that other suitable structures that enable such movement of the cap 814, and the associated projection 818 with the penetrable seal 828, can also be employed and are within the scope of the invention. For example, the cap 814 and fitting 824 of the seal device 800 could define a series of mated baffles that allow the cap 814 to be pushed downward (i.e., toward the fitting 824) when a user desires to access the formula or fluid in the container.

Figure 13:
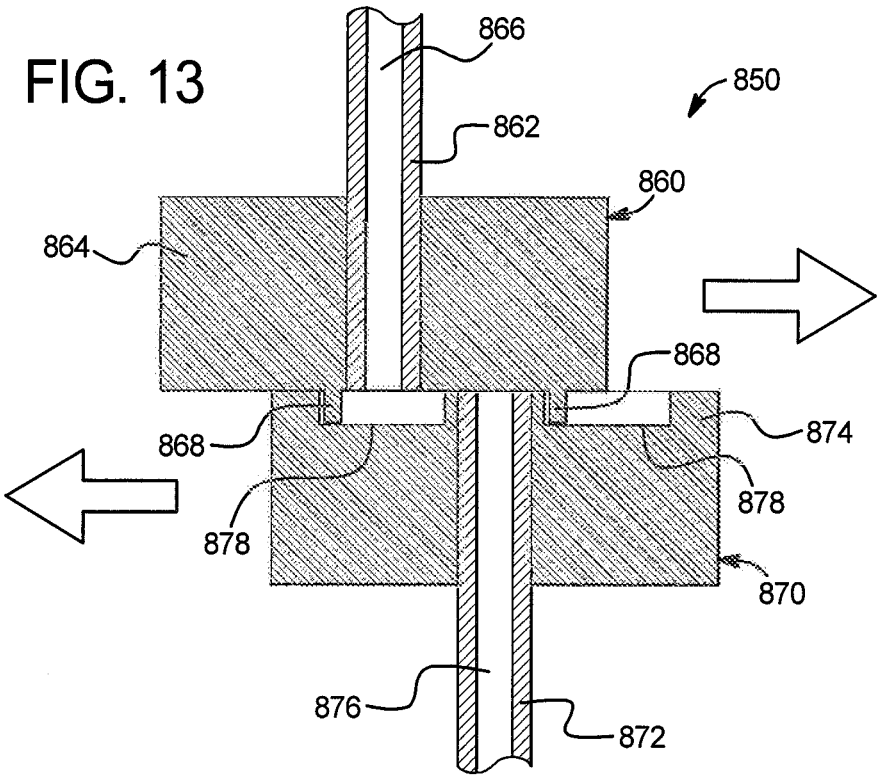
FIG. 13 is a sectional view of a seal device for the integrated storage and delivery system according to another exemplary embodiment.

FIG. 13 illustrates a seal device 850 for the integrated storage and delivery system 700 according to another exemplary embodiment. The seal device 850 comprises a first assembly 860 attached to a second assembly 870. The first assembly 860 is attached to a first tubing 862, which can be attached to any suitable patient access tip. The second assembly 870 is attached to a second tubing 872, which can be attached to a storage container. The first assembly 860 includes a first base 864 that defines a first passageway 866. The first base 864 further comprises one or more protrusions 868. The second assembly 870 comprises a second base 874 that defines a second passageway 876. The second base further defines one or more grooves 878.

The one or more protrusions 868 of the first base 864 and the one or more grooves 878 of the second base 874 are constructed and arranged slidably attach to each others. For example, the protrusions 868 comprise a shape (e.g. t-shape) that can be locked within and slide along the grooves 878. In another embodiment, the first base 864 comprises one or more grooves, and the second base defines one or more protrusions (operating in a similar manner as described above). It should be appreciated that the first base 864 of the first assembly 860 can be slidably engaged with the second base 874 of the second assembly 870 in a similar manner using any other suitable mechanisms.

In the storage position, the first base 864 of the first assembly 860 is with the second base 874 of the second assembly 870 so that the first passageway 866 and the second passageway 876 are not aligned as illustrated in FIG. 13. Movement of the formula or liquid through the seal device 850 can be initiated by sliding the first assembly 860 adjacently along the second assembly 870 so that any portions of the first passageway 866 and the second passageway 876 are aligned. At this point, the movement of the formula or liquid through the seal device 800 can occur. Maximum flow of the formula or liquid through the seal device 800 occurs when the first passageway 866 and the second passageway 876 are completely aligned.

In an alternative embodiment, the one or more grooves of the second base can be curved so that the non-alignment and the alignment of the first passageway and the second passageway can be performed by rotating the first base with respect to the second base. It should be appreciated that the first base can be slidably connected to the second base using any suitable attachment that allows one or more first passageways and one or more second passageways to move from a non-aligned position to an aligned position and vice versa in a manner similar to the exemplary embodiments.

Figure 14A:
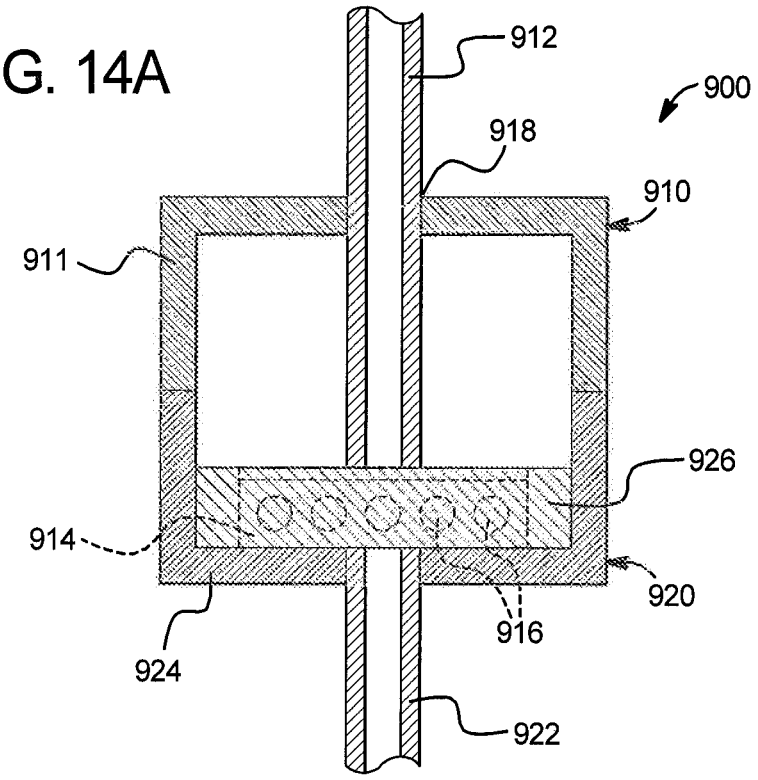
FIGS. 14A and 14B are sectional views of a seal device for the integrated storage and delivery system according to another exemplary embodiment.
Figure 14B:
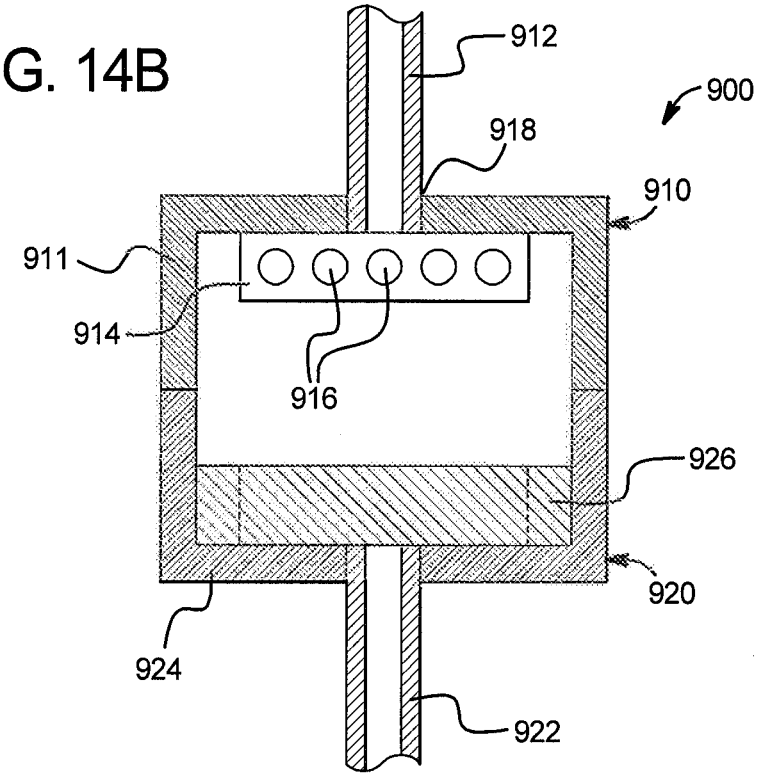

FIGS. 14A and 14B illustrate a seal device 900 for the integrated storage and delivery system 700 according to another exemplary embodiment. The seal device 900 comprises a first assembly 910 attached to a second assembly 920. The first assembly 910 comprises a cap 911 is attached to a first tubing 912, which can be attached to any suitable patient access tip or storage container. The first tubing 912 is slidably attached within an opening 918 in the cap 911. The first assembly 910 includes a first base 914 that defines one or more outlets 916. The first base 914 is attached to the end of the first tubing 912, and the one or more outlets 916 lead directly to a passage of the first tubing 912.

The second assembly 920 is attached to a second tubing 922, which can be attached to a storage container or suitable patient access tip. The second assembly 920 comprises a second base 924 that defines a recessed portion 926. The recessed portion 926 leads directly to the passage of the second tubing 922. A portion of the cap 911 is attached to a portion of the second base 924 as illustrated in FIGS. 14A and 14B.

The first base 914 of the first assembly 910 engages the second base 924 of the second assembly 920. In the storage position, the recessed portion 926 of the second base 924 is constructed and arranged to receive the first base 914 of the first assembly 910 in a manner that the one or more outlets 916 are completely enclosed and sealed off within the recessed portion 924 as illustrated in FIG. 14A. The first base 914 can comprise any suitable shape as long as the recessed portion 926 of the second base 924 is constructed and arranged to receive the shape of the first base 914 in the manner previously described.

Movement of the formula or liquid through the seal device 900 can be initiated be detaching the first base 914 of the first assembly 910 from the recessed portion 926 of the second base 924 as illustrated in FIG. 14B. At this point, the movement of the formula or liquid through the seal device 800 from tubing 912 to tubing 922 or vice versa can be initiated.

The first base 914 can be releasably attachable within the recessed portion 926 of the second base 924, for example, based on the tightness of the first base 914 within the recessed portion 926. It should be understood that other suitable structures that enable that attachment and release of the first base 914 into and out of the recessed portion 926 can also be employed and are within the scope of the invention. For example, the first base 914 and the second base 824 of the seal device 900 could define a corresponding set of snap fittings that allow the first base 914 to be snapped into and out of the recessed portion 926 of the second base 824 when a user desires to access the formula or fluid in the container.

In an alternative embodiment of the seal device 900 for the integrated storage and delivery system, the seal device comprises a first assembly comprising a first base attached to an end portion of a tubing. The first base defines one or more first outlets. The outlets lead directly into the attached tubing. The seal device further comprises a second assembly movably attached to the first assembly. The second assembly comprises a second base defining a recessed portion and one or more second outlets. The second outlets lead directly into a tubing attached to the second assembly. The recessed portion of the second base is constructed and arranged to receive the first base In this embodiment, the first base is rotatably attached to the recessed portion of the second base. For example, the first base and the second base are rotatable between a non-aligned position between the one or more first outlets and one or more second outlets that prevents passage of a fluid from the container to the access tip and an aligned position that partially or completely lines up the one or more first outlets with corresponding one or more second outlets that allows passage of the fluid from the container to the access tip.

Figure 15A:
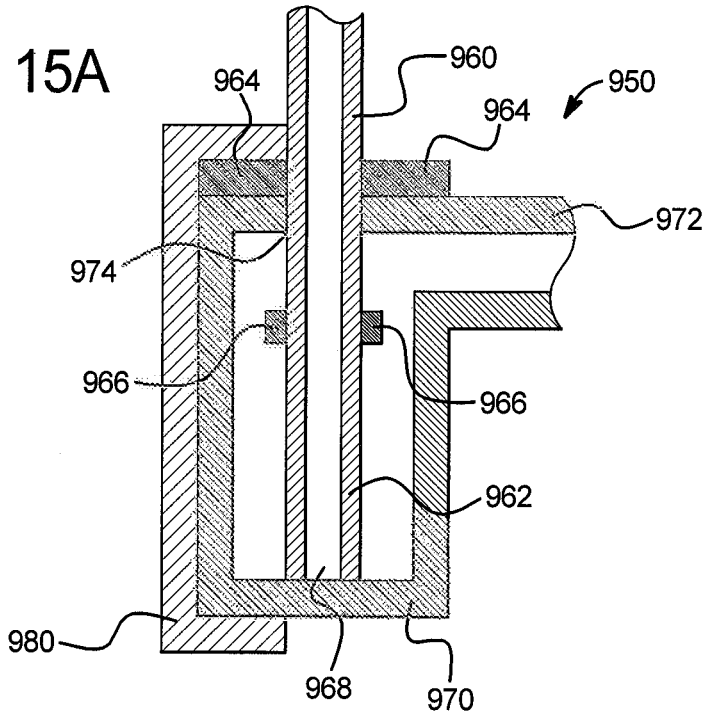
FIGS. 15A and 15B are sectional views of a seal device for the integrated storage and delivery system according to another exemplary embodiment.
Figure 15B:
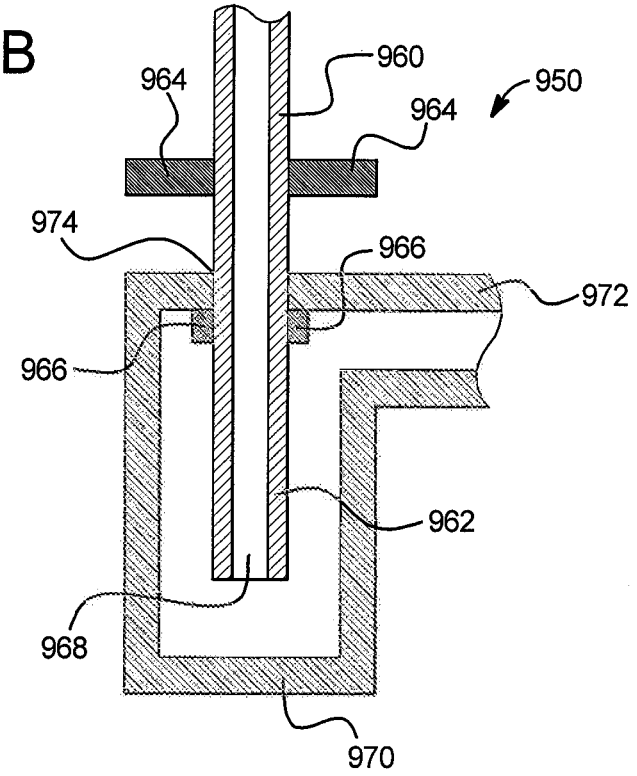

FIGS. 15A and 15B illustrate a seal device 950 for the integrated storage and delivery system 700 according to another exemplary embodiment. The seal device 950 comprises a first tubing 960 having an end portion 962 attached to a chamber 970. The first tubing 960, which can be attached to any suitable patient access tip or storage container. The chamber 970 is attached to a second tubing 972, which can be attached to a storage container or suitable patient access tip. The end portion 962 of the first tubing 960 includes one or more first stops 964 and one or more second stops 966. The chamber 970 defines an opening 974 that receives the end portion 962 of the first tubing 960.

A locking mechanism 980 is placed over the one or more first stops 964 and a bottom portion 976 of the chamber 970 to lock the end portion 962 of the first tubing 960 within the chamber 970. It should be appreciated that the locking mechanism 980 can be any suitable mechanism that compresses the end portion 962 of the first tubing 960 into the chamber sufficiently so that an open end 968 of the first tubing 960 is compressed against a wall of the chamber 970 thereby blocking flow through the open end 968 of the first tubing 960. For example, the locking mechanism 980 can comprise a removable tear strip or screwing device that can be unscrewed to remove the compression at the opening end of the first tubing 960. The locking mechanism 980 can be made of any suitable materials.

As illustrated in FIGS. 15A and 15B, the end portion 962 of the first tubing 960 is constructed and arranged so that the one or more first stops 964 are arranged outside the chamber 970 and the one or more first stops 966 are arranged inside the chamber 970. This arrangement allows the end portion 962 to move back and forth with the chamber 970 while preventing the end portion 962 from being completely removed from the chamber. The opening 974 of the chamber 970 can slidably receive the end portion 962 of the first tubing 960 and tightly fit around the end portion 962 so that formula or liquid does not leak out from the opening 974 during use.

Movement of the formula or liquid through the seal device 950 can be initiated by removing the locking mechanism 980. Once the locking mechanism 980 is removed, the end portion 962 of the first tubing 960 can be pulled away from a wall of the chamber 970 thereby exposing the open end of the first tubing 960. At this point, the movement of the formula or liquid can occur through the seal device 800 from the first tubing 960 to the second tubing 972 or vice versa.

Although not shown, the seal device 900 can also comprise a locking mechanism releasably attached to the cap 911 and/or tubing 912 (e.g. that is slidably attached to the first assembly 910) and a bottom portion of the second assembly 920 to lock the first base 914 within the recessed portion 926 of the second assembly. For example, the locking mechanism can comprise a removable tear strip or screwing device that, when removed, allows the first base 914 to be released/detached from the recessed portion 926.

The components described for each of the exemplary embodiments can be formed and made from conventional materials known to those skilled in the art as well as any suitable materials hereinafter developed. Those skilled in the art can select appropriate materials for each of the components based on various considerations, including the nature of the formula or other fluid being used with an integrated storage and delivery system according to a particular embodiment.

While the integrated storage and delivery system is described in the context of nutritional compositions, such as formula for non-oral delivery to patients, it is expressly understood and contemplated that systems according to the invention have utility with other fluids and in other technological fields.

Figure 16:
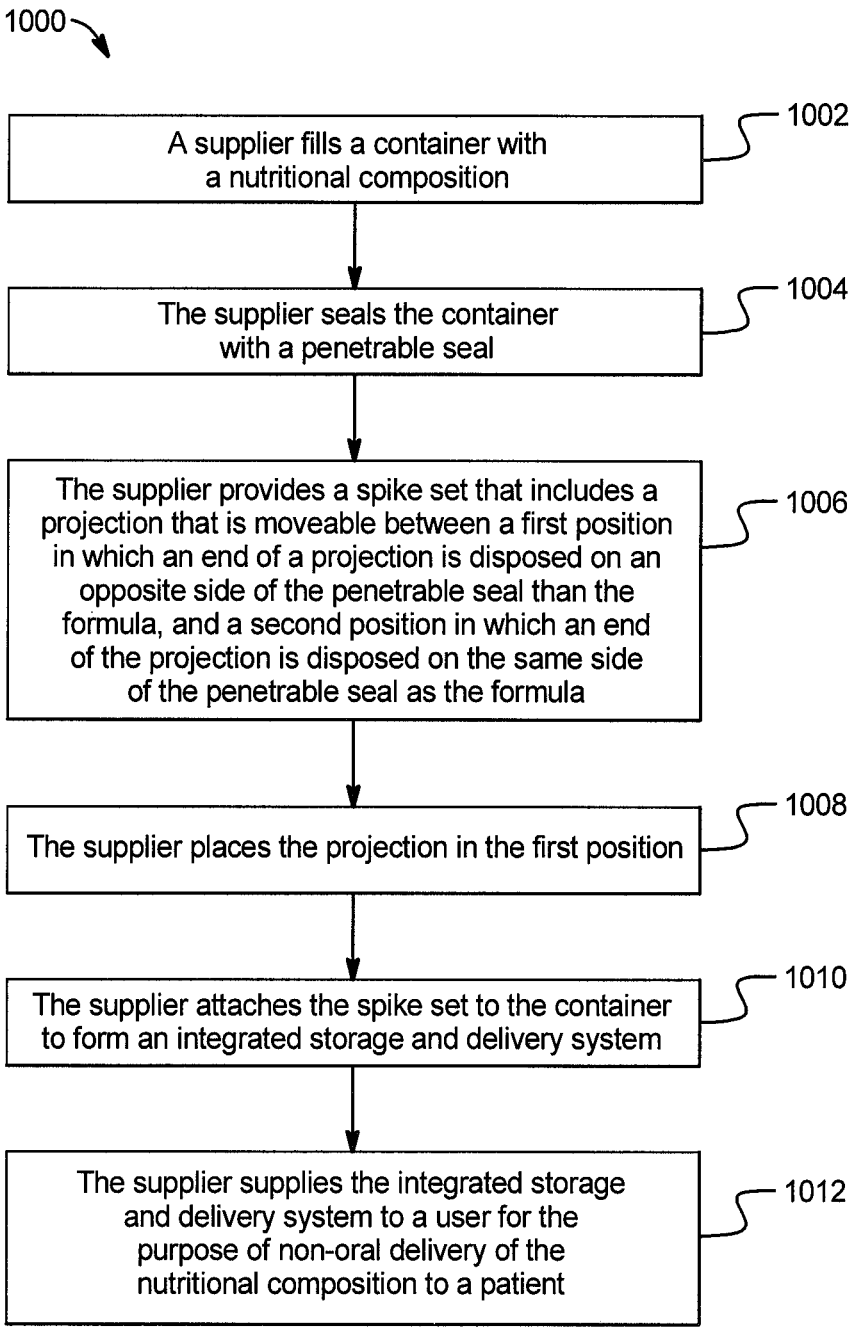
FIG. 16 is a flow chart illustrating an exemplary method of supplying nutritional compositions for non-oral delivery to a patient.

The invention also provides methods of supplying a nutritional composition to a user for non-oral delivery to a patient, such as a human patient. FIG. 16 illustrates a flow chart representing an exemplary such method 1000. In a first step 1002, a supplier fills a container with a nutritional composition. In a second step 1004, the supplier seals the container with a penetrable seal. In a third step 1006, the supplier provides a spike set that includes a projection that is moveable between a first position in which an end of the projection is disposed on an opposite side of the penetrable seal than the formula, and a second position in which an end of the projection is disposed on the same side of the penetrable seal as the formula. In a fourth step 1008, the supplier places the projection in the first position. In a fifth step 1010, the supplier attaches the spike set to the container to form an integrated storage and delivery system. In a sixth step 1012, the supplier supplies the integrated storage and delivery system to a user for the purpose of non-oral delivery of the nutritional composition to a patient.

At least the filling 1002 and sealing 1004 steps should be performed using standard aseptic technique, and are advantageously performed under sterile conditions. In an exemplary embodiment, all steps up to and including the step 810, in which the supplier attaches the spike set to the container to form an integrated storage and delivery system, are performed using standard aseptic technique and under sterile conditions.

As used herein, the term "patient" refers to any suitable animal, including human and non-human animals. Examples include, but are not limited to, mammals, including but not limited to, rodents, aquatic mammals, domestic animals such as dogs and cats, farm animals such as sheep, cows, horses, and humans. Wherein the terms animal or mammal or their plurals are used, it is contemplated that it also applies to any animals that are capable of the effect exhibited or intended to be exhibited by the context of the passage.

As used herein, the term "nutritional composition" includes, but are not limited to: complete nutritional compositions, partial or incomplete nutritional composition, and disease or condition specific nutritional composition.

A complete nutritional composition (i.e. those which contain all the essential macro and micro nutrients) can be used as a sole source of nutrition for the patient. Patients can receive 100% of their nutritional requirements from such complete nutritional composition.

A partial or incomplete nutritional composition does not contain all the essential macro and micro nutrients and cannot be used as a sole source of nutrition for the patient. Partial or incomplete nutritional composition are used as a nutritional supplement.

A disease or condition specific nutritional composition is a composition that delivers nutrients or pharmaceuticals and can be a complete or partial nutritional composition. Disease or condition specific nutritional composition are those design to aid with a given situation, such as Impact® sold by Nestlé Nutrition to decrease post-operative infections, Diabetisource AC® sold by Nestlé Nutrition for people with Diabetes or hyperglycemia, Novasource® Pulmonary sold by Nestlé Nutrition for those patients with pulmonary disease or those requiring ventilator support.

The steps of the method can be accomplished in any suitable order, and the order of steps presented is merely an example of a suitable order. Furthermore, where appropriate, steps can be combined and or eliminated. For example, the step 1008 of placing the projection in the first position can be combined with the step 1006 of providing a spike set by simply providing a suitable spike set that already includes the projection in the first position.

Another exemplary method of supplying a nutritional composition to a user for non-oral delivery to a patient comprises the step of selling an integrated storage and delivery system according to the invention to the user.

Another exemplary method of supplying a nutritional composition to a user for non-oral delivery to a patient comprises the step of selling a kit according to the invention to the user.

The invention also provides kits useful in the administration of fluids, such as nutritional compositions, to patients, including human patients. A kit according to one exemplary embodiment comprises a container defining a chamber, a finish, and a penetrable seal. The finish defines an opening and the penetrable seal separates the chamber from an external environment. The kit also includes a spike assembly that includes a cap and a spike. The cap is adapted to be sealingly attached to the container, such as by a threaded connection, adhesive, or other suitable means for forming an attachment. The spike provides a projection that is moveable between a first position and a second position when the cap is attached to and moved relative to the container. In the first position, at least a portion of the projection is adjacent a first side of the penetrable seal; in the second position, at least a portion of the projection is adjacent a second side of the penetrable seal.

The spike assembly can optionally include a length of tubing and a patient access tip adapted for insertion into a patient at a point of treatment.

The components of the kit can be provided in assembled form, thereby providing an integrated storage and delivery system according to the invention. Alternatively, the components can be provided in a form that requires assembly. For example, the container can be provided pre-filled and sealed, along with a spike assembly in the same kit. In these embodiments, instructions relating to the assembly of the components to form an integrated storage and delivery system can be provided in the kit.

Methods of reducing the possibility of contamination of an enteral feeding formulation for delivery to a patient are also provided. An exemplary method comprises the step of providing a predetermined amount of an enteral feeding formulation to a user in a pre-filled container along with a spike assembly. The container is provided with a seal that separates the enteral feeding formulation from an external environment and the spike assembly is adapted to disrupt the seal to permit flow of the enteral feeding formulation from the container to a point of treatment in said patient. The possibility of contamination of the enteral feeding formulation is reduced at least because the pre-filled container and the spike assembly are provided to the user together, such as in a kit according to the invention.

Methods of preventing or reducing infection of a patient fed an enteral feeding formulation are also provided. An exemplary method comprises the steps of delivering the enteral feeding formulation to the patient from an integrated storage and delivery system according to the invention.

Methods of prolonging the life of an enteral feeding tube are also provided. An exemplary method comprises the step of providing an enteral feeding tube as a component of a spike assembly along with a pre-filled container holding a predetermined amount of an enteral feeding formulation and having a penetrable seal separating the enteral feeding formulation from an external environment. The spike assembly is adapted to be attached to the pre-filled container and disrupt the seal to effect flow of the enteral feeding formulation from the container and into the enteral feeding tube. The life of the enteral feeding tube is prolonged because the risk of contamination is reduced by way of the enteral feeding tube being provided along with a pre-filled container of a formulation for which the tube will be used to deliver to a patient.

Methods according to the invention are useful in a variety of fields, including the care of veterinary and human patients.

It is expressly understood that all singular terms used herein include the plural forms, and all plurals used herein include the singular forms.

The foregoing detailed description provides exemplary embodiments of the invention and includes the best mode for practicing the invention. The description and illustration of embodiments is intended only to provide examples of the invention and not to limit the scope of the invention, or its protection, in any manner.

I claim:

1. An integrated storage and delivery system for nutritional compositions, the integrated storage and delivery system comprising:

a container defining a chamber, a finish, and a penetrable seal, the finish defining an opening and the penetrable seal separating the chamber from an external environment;

a spike assembly attached to the container, the spike assembly including a cap and a spike, the cap engaged with the finish of the container and the spike defining a projection having a distal end defining a second opening, the projection moveable between a first position in which the distal end is adjacent a first side of the penetrable seal and a second position in which the distal end is adjacent a second side of the penetrable seal, the cap defining a first thread and the projection defining a second thread complementary to the first thread, the first and second threads defining a thread path, and the projection moving between the first and second positions by advancement along the thread path, the cap defines an upstanding portion that receives the projection, an inner surface of the upstanding portion defines the first thread, the upstanding portion defines a passage that opens through an upper surface of the upstanding portion, the spike assembly comprises a downward-facing surface located above the second thread of the projection, and the downward-facing surface of the spike assembly is distanced from the upper surface of the upstanding portion in the first position of the projection and abuts the upper surface of the upstanding portion in the second position of the projection; and a tubing attached to the cap, the spike is integrally attached to the cap, and the passage of the upstanding portion is in fluid communication with a passage of the tubing.

2. The integrated storage and delivery system according to claim 1, further comprising a fluid disposed in the chamber.

3. The integrated storage and delivery system according to claim 2, wherein the fluid comprises a formula for non-oral delivery to the patient.

4. The integrated storage and delivery system according to claim 3, wherein the patient comprises an animal.

5. The integrated storage and delivery system according to claim 4, wherein the animal comprises a mammal.

6. The integrated storage and delivery system according to claim 5, wherein the mammal comprises a human.

7. The integrated storage and delivery system according to claim 1, further comprising a tear strip releasably attached to at least one of the finish and the cap.

8. The integrated storage and delivery system according to claim 1, wherein the cap comprises a flexible material.

9. The integrated storage and delivery system according to claim 1, wherein the projection comprises a needle.

10. A method of reducing the possibility of contamination of an enteral feeding formulation for delivery to a patient, the method comprising:

providing a predetermined amount of the enteral feeding formulation to a user from the integrated storage and delivery system of claim 1.

11. A method of preventing or reducing infection of a patient fed an enteral feeding formulation, the method comprising:

delivering the enteral feeding formulation to the patient from an integrated storage and delivery system according to claim 1.

12. A method of prolonging the life of an enteral feeding tube, the method comprising:

providing the enteral feeding tube as the tubing in the integrated storage and delivery system of claim 1.

13. A method of supplying a nutritional composition to a user for non-oral delivery to a patient, the method comprising the step of selling the system of claim 1 to the user.

14. The integrated storage and delivery system according to claim 1, wherein the second thread is vertically aligned with the distal end.

15. An integrated storage and delivery system for nutritional compositions, the integrated storage and delivery system comprising:

a container defining a chamber, a finish, and a penetrable seal, the finish defining an opening and the penetrable seal separating the chamber from an external environment; and a spike assembly attached to the container, the spike assembly including a cap and a spike, the cap engaged with the finish of the container and the spike defining a projection having a distal end defining a second opening, the projection moveable between a first position in which the distal end is adjacent a first side of the penetrable seal and a second position in which the distal end is adjacent a second side of the penetrable seal, the cap defining a first thread and the projection defining a second thread complementary to the first thread, the first and second threads defining a thread path, and the projection moving between the first and second positions by advancement along the thread path, the cap defines an upstanding portion that receives the projection, an inner surface of the upstanding portion defines the first thread, the upstanding portion defines a passage that opens through an upper surface of the upstanding portion, the spike assembly comprises a downward-facing surface located above the second thread of the projection, and the downward-facing surface of the spike assembly is distanced from the upper surface of the upstanding portion in the first position of the projection and abuts the upper surface of the upstanding portion in the second position of the projection, wherein the spike assembly further comprises a patient access tip adapted for insertion into a patient at a point of treatment;

wherein the patient access tip includes a distal end defining a third opening; and wherein the spike assembly defines a passageway extending from the second opening defined by the distal end of the projection to the third opening defined by the patient access tip.

16. The integrated storage and delivery system according to claim 15, wherein the spike assembly further comprises a length of tubing defining a lumen and disposed between the spike and the patient access tip such that the passageway extends through the lumen.

17. A method of supplying a nutritional composition to a user for non-oral delivery to a patient, the method comprising:

filling a container with the nutritional composition, the container defining a chamber and a finish, the finish defining a first opening;

sealing the first opening of the container with a penetrable seal separating the chamber from an external environment;

providing a spike assembly that includes a cap and a spike, the spike defining a projection having a distal end defining a second opening, the cap defining a first thread and the projection defining a second thread complementary to the first thread, the first and second threads defining a thread path, the cap defines an upstanding portion that receives the projection, an inner surface of the upstanding portion defines the first thread, the upstanding portion defines a passage that opens through an upper surface of the upstanding portion, the spike assembly comprises a downward-facing surface located above the second thread of the projection, a tubing is attached to the cap, the spike is integrally attached to the cap, and the passage of the upstanding portion is in fluid communication with a passage of the tubing;

attaching the spike assembly set to the container by engaging the cap with the finish of the container to form an integrated storage and delivery system;

moving the projection between a first position in which the projection is disposed on an opposite side of the penetrable seal than the nutritional composition and a second position in which the projection is disposed on the same side of the penetrable seal as the nutritional composition, the projection moving between the first and second positions by advancement along the thread path, the distal end in the first position of the projection is adjacent a first side of the penetrable seal, the distal end in the second position of the projection is adjacent a second side of the penetrable seal, the downward-facing surface of the spike assembly is distanced from the upper surface of the upstanding portion in the first position of the projection and abuts the upper surface of the upstanding portion in the second position of the projection; and supplying the integrated storage and delivery system to the user for non-oral delivery to the patient.

18. The method according to claim 17, wherein the patient comprises an animal.

19. The method according to claim 18, wherein the animal comprises a mammal.

20. The method according to claim 19, wherein the mammal comprises a human.

21. A kit comprising:

a container defining a chamber, a finish, a penetrable seal, and a predetermined amount of a liquid within the chamber, the penetrable seal separating the liquid from an external environment, and the finish defining a first opening; and a spike assembly comprising a cap adapted to be sealingly attached to the finish of the container and comprising a spike defining a projection having a distal end defining a second opening, the projection is moveable between a first position and a second position when the cap is attached to and moved relative to the container, the cap defining a first thread and the projection defining a second thread complementary to the first thread, the first and second threads defining a thread path, and the projection moving between the first and second positions by advancement along the thread path, the distal end in the first position of the projection is adjacent a first side of the penetrable seal, the distal end in the second position of the projection is adjacent a second side of the penetrable seal, the cap defines an upstanding portion that receives the projection, an inner surface of the upstanding portion defines the first thread, the upstanding portion defines a passage that opens through an upper surface of the upstanding portion, the spike assembly comprises a downward-facing surface located above the second thread of the projection, and the downward-facing surface of the spike assembly is distanced from the upper surface of the upstanding portion in the first position of the projection and abuts the upper surface of the upstanding portion in the second position of the projection, a tubing is attached to the cap, the spike is integrally attached to the cap, and the passage of the upstanding portion is in fluid communication with a passage of the tubing.

22. The kit according to claim 21, wherein the container and the spike assembly are provided as separate components.

23. The kit according to claim 22, further comprising instructions for assembling the container and the spike assembly into an integrated storage and delivery system.

24. The kit according to claim 21, wherein the spike assembly is attached to the container.

25. The kit according to claim 24, wherein a tear strip is releasably attached to at least one of the finish and the cap.

26. The kit according to claim 21, wherein the liquid comprises a nutritional composition suitable for non-oral delivery to a patient.

27. The kit according to claim 21, wherein the liquid comprises a nutritional composition suitable for non-oral delivery to a human.

28. A method of supplying a nutritional composition to a user for non-oral delivery to a patient, the method comprising the step of selling the kit of claim 21 to the user.

* * * * *